US010036116B2

(12) United States Patent
Jo et al.

(10) Patent No.: US 10,036,116 B2
(45) Date of Patent: Jul. 31, 2018

(54) WASHING MACHINE

(71) Applicant: LG ELECTRONICS INC., Seoul (KR)

(72) Inventors: Mingyu Jo, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 62 days.

(21) Appl. No.: 14/987,384

(22) Filed: Jan. 4, 2016

(65) Prior Publication Data

US 2016/0194810 A1 Jul. 7, 2016

(30) Foreign Application Priority Data

Jan. 5, 2015 (KR) ..... 10-2015-0000528

(51) Int. Cl.

*D06F 39/02* (2006.01)
*D06F 39/12* (2006.01)
*D06F 39/08* (2006.01)

(52) U.S. Cl.

CPC ..... *D06F 39/02* (2013.01); *D06F 39/028* (2013.01); *D06F 39/12* (2013.01); *D06F 39/088* (2013.01)

(58) Field of Classification Search

CPC ..... D06F 37/10; D06F 37/18; D06F 39/014; D06F 39/02; D06F 39/022; D06F 39/028; D06F 49/003; D06F 23/04; D06F 37/12; D06F 37/24; D06F 37/28; A47L 15/44; A47L 15/4409; A47L 15/4418

See application file for complete search history.

(56) References Cited

U.S. PATENT DOCUMENTS 3,350,152 A * 10/1967 Bang ..... A47F 3/043 312/100
4,510,776 A * 4/1985 McNally ..... D06F 37/28 312/139.2
5,588,313 A * 12/1996 Hildebrand ..... D06F 25/00 68/17 R (Continued)

FOREIGN PATENT DOCUMENTS

JP 2004-033725 A 2/2004
JP 2005-137944 A 6/2005

(Continued)

OTHER PUBLICATIONS

KR20100110504—Machine Translation, Oct. 2010.*

(Continued)

*Primary Examiner* — Mikhail Kornakov
*Assistant Examiner* — Marc Lorenzi
(74) *Attorney, Agent, or Firm* — Dentons US LLP

(57) ABSTRACT

The washing machine includes a cabinet including an upper cover forming the rear part of the upper surface of the cabinet, a tub in the cabinet, a detergent dispenser, which is over the front part of the tub and which is not covered by the upper cover and is exposed, a dispenser cover, which opens and closes the upper face of the detergent dispenser, which is not covered by the upper cover and is exposed and which forms the front part of the upper surface of the cabinet, and a lock unit for maintaining the open or closed state of the dispenser cover while the dispenser cover is open or closed.

14 Claims, 19 Drawing Sheets

(56) References Cited

U.S. PATENT DOCUMENTS

| | | | | |
|---|---|---|---|---|
| 2004/0144138 | A1* | 7/2004 | Takeuchi | D06F 39/14 68/24 |
| 2007/0256715 | A1* | 11/2007 | Oppel | A47L 15/4259 134/57 DL |
| 2009/0288687 | A1* | 11/2009 | Marone | A47L 15/4409 134/93 |
| 2013/0327101 | A1* | 12/2013 | Leibman | D06F 71/10 68/17 R |
| 2014/0375199 | A1 | 12/2014 | Lee et al. | |

FOREIGN PATENT DOCUMENTS

| | | | | | |
|---|---|---|---|---|---|
| KR | 20030050287 | A | * | 6/2003 | |
| KR | 20100110504 | A | * | 10/2010 | |
| KR | 10-2010-0124126 | A | | 11/2010 | |
| KR | 20100124128 | A | * | 11/2010 | |
| KR | 10-2014-0045677 | A | | 4/2014 | |
| WO | WO 2013032224 | A2 | * | 3/2013 | D06F 39/02 |

OTHER PUBLICATIONS

KR20100124128—Machine Translation, Nov. 2010.*
KR20100124126—Machine Translation, Nov. 2010.*
KR20030050287—Machine Translation (Year: 2003).*

* cited by examiner

- RELATED ART -

WASHING MACHINE

CROSS REFERENCE TO RELATED APPLICATIONS

Pursuant to 35 U.S.C. § 119(a), this application claims the benefit of Korean Patent Application No. 10-2015-0000528, filed on Jan. 5, 2015, which is incorporated by reference for all purposes as if fully set forth herein.

BACKGROUND

Field of the Disclosure

The present disclosure relates to a washing machine, and more particularly to a washing machine, which is provided on the upper surface thereof with a detergent dispenser which includes a dispenser cover for opening and closing the detergent dispenser.

Discussion of the Related Art

Generally, a washing machine can be a drying apparatus for drying laundry, a washing apparatus for washing laundry, and the like. The washing machine, in particular, the washing apparatus, uses detergent, and the like, to wash laundry. To this end, the washing apparatus is typically provided with a detergent dispenser. Accordingly, the detergent dispenser is considered an essential component, particularly in the washing apparatus.

Hereinafter, a conventional detergent dispenser of the related art is briefly described with reference to an accompanying drawing.

FIG. 1 is a perspective view showing a conventional washing machine and a detergent dispenser incorporated in the washing machine of the related art.

As shown in FIG. 1, the conventional washing machine 10 includes a cabinet 11 defining the appearance of the washing machine 10, a tub (not shown), which is disposed in the cabinet 11 so as to contain washing water, and a drum 12, which is rotatably disposed in the tub so as to contain and wash laundry introduced thereinto. The washing machine 10 is provided with a detergent dispenser 20, which introduces detergent into the drum 13 in order to improve the effectiveness with which laundry is washed.

The detergent dispenser 20 typically includes a drawer-type detergent receiver 22, which is able to be drawn partway out in the forward direction of the washing machine 10. For the operation of washing laundry, detergent is put into the drawn detergent receiver 22, and the detergent receiver 22 is mounted into the detergent dispenser 20.

In other words, the detergent dispenser 20 includes the detergent receiver 22, and detergent introduced into the detergent receiver 22 is supplied together with washing water into the tub or drum, which is a space for washing laundry.

When it is intended to introduce detergent into the detergent dispenser 20 of a conventional washing machine 10, the detergent dispenser 20 is maintained in the state of being drawn outward from the washing machine 10, and a user lifts a detergent container and introduces the detergent into the detergent dispenser.

In the case of the conventional detergent dispenser 20, because detergent must be introduced into the detergent dispenser 20 while the detergent dispenser 20 is in the state of being drawn out from the front face of the washing machine 10, a user has to introduce the detergent into the detergent dispenser 20 while lifting the detergent container or maintaining the spout of the detergent container on the detergent dispenser 20.

However, when a user introduces the detergent into the detergent dispenser 20 while lifting the detergent container, the user has to exert a great deal of force to lift up the detergent container, thereby being inconvenient to the user. Meanwhile, when a user introduces the detergent into the detergent dispenser 20 while maintaining the spout of the detergent container on the detergent dispenser 20, there is a problem in that the detergent dispenser 20 may break due to the weight of the detergent container.

Furthermore, in the case of a conventional detergent dispenser 20, the detergent dispenser 20 must be drawn out from the washing machine 10 in order to introduce the detergent. Accordingly, in order to allow the detergent dispenser 20 to be drawn out from the washing machine 10, the detergent dispenser 20 must be provided on the front face of the washing machine 10, thereby restricting the design of the front face of the washing machine 10.

SUMMARY

Accordingly, the present disclosure is directed to a washing machine that substantially obviates one or more problems due to limitations and disadvantages of the related art.

An object of the present disclosure is to provide a washing machine in which the position of the detergent dispenser is changed and the structure of which is improved so as to allow a user to easily introduce detergent into the washing machine.

Another object of the present disclosure is to provide a washing machine which is improved with respect to the position and structure of the detergent dispenser, thereby eliminating restrictions relating to the design of the washing machine.

A further object of the present disclosure is to provide a washing machine which restricts opening and closing action of the door for opening and closing the detergent dispenser so as to prevent unintentional opening of the door.

Additional advantages, objects, and features of the disclosure will be set forth in part in the description which follows and in part will become apparent to those having ordinary skill in the art upon examination of the following, or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the invention, as embodied and broadly described herein, a washing machine includes a cabinet including an upper cover forming the rear part of the upper surface of the cabinet, a tub in the cabinet, a detergent dispenser, which is over the front part of the tub and which is not covered by the upper cover and is exposed, a dispenser cover, which opens and closes the upper face of the detergent dispenser, which is not covered by the upper cover is exposed, and which forms the front part of the upper surface of the cabinet, and a lock unit for maintaining the open or closed state of the dispenser cover while the dispenser cover is open or closed.

The dispenser cover may include a door bracket over the detergent dispenser, and a sliding door, which is slidably coupled to the door bracket and which slides so as to open and close the detergent dispenser.

The door bracket may include a body part having a through hole through which detergent is introduced into the detergent dispenser, and a plurality of guide parts, which are on both lateral sides of the body part and are in inner facing surfaces thereof with first and second guide slits for guiding the sliding door, wherein the sliding door includes first and second slide protrusions formed on both lateral sides thereof, which are inserted into the first and the second guide slits, respectively.

The first and the second guide slits may be inclined downward in the direction in which the sliding door opens.

The second guide slits may have a greater angle of inclination than the first guide slits.

The upper cover may be on the front part of the upper surface thereof with a recessed surface, and the sliding door may be at the rear part of the upper surface thereof with a recessed surface, which is flush with the recessed surface of the upper cover.

The front edge of the sliding door is the front edge of the cabinet, and a connecting surface is between the upper surface of the sliding door and the front cover of the cabinet to connect the upper surface of the sliding door to the front cover of the cabinet.

The connecting surface may include a flat or a curved surface.

The lock unit may be at the sliding door to restrict the movement of the sliding door when the sliding door is opened and closed.

The lock unit may be inside a handle provided on the sliding door.

The lock unit may include a push lever, which is inside a handle provided on the sliding door, a locking protrusion, and a return spring for maintaining the normal position of the push lever, and whereby, when the push lever is pushed, the locked state of the locking protrusion is released, and the sliding door thus becomes movable.

The dispenser cover may form the front part of the upper surface of the cabinet, and the front edge of the upper surface of the cabinet.

The rear part of the upper surface of the cabinet is formed by the upper cover, and the front part of the upper surface of the cabinet is formed by the dispenser cover.

The dispenser cover may slide under the upper cover when the detergent dispenser is opened.

The washing machine may further include an air supply unit, which includes an introduction portion on the circumferential surface of a rear part of the tub, a discharge portion disposed at the center of the front part of the tub, and a duct, which is connected to both the discharge portion and the introduction portion and extends to a center of the front part of the tub from a portion of the rear part of the tub.

The detergent dispenser may be over the front part of the tub, and may extend such that the detergent introduction holes in the detergent dispenser are on both sides of the duct.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE DISCLOSURE

Hereinafter, a washing machine according to an exemplary embodiment of the present disclosure is described in detail with reference to the accompanying drawings.

Prior to the description of the present disclosure, it should be noted that terms of components, which are defined in the description, are terms defined in consideration of their function in the present disclosure. Therefore, the terms should not be construed as limiting the technical components of the present disclosure. The terms, which are defined for respective components, may be referred to by other terms in the field.

The present disclosure is directed to a washing machine, and more particularly to a detergent dispenser.

It should be noted that the components of the washing machine other than the detergent dispenser are substantially identical to the components of a typical washing machine, and the structural identity of the washing machine does not limit the technical idea of the present disclosure. Therefore, the general components of the washing machine will be described briefly, whereas the detergent dispenser will be described in detail.

The washing machine according to an embodiment of the present disclosure is first described in detail with reference to FIGS. 2 and 3.

Figure 1:
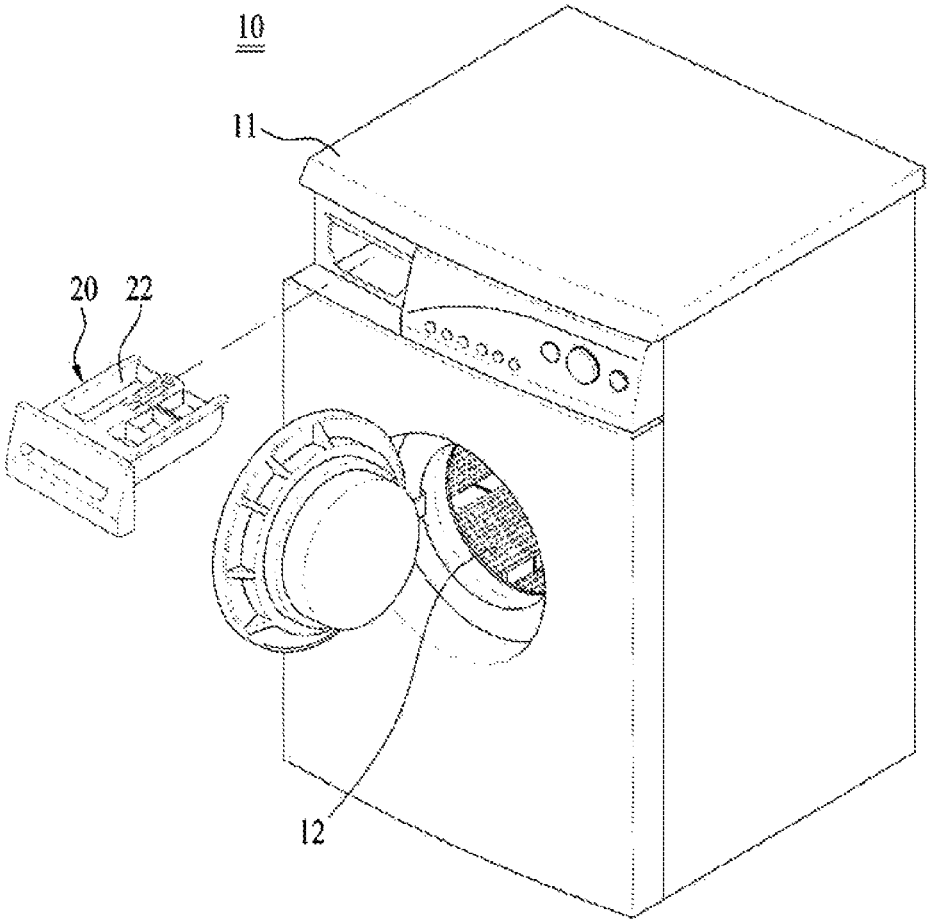
FIG. 1 is a perspective view showing a conventional washing machine of the related art.
Figure 2:
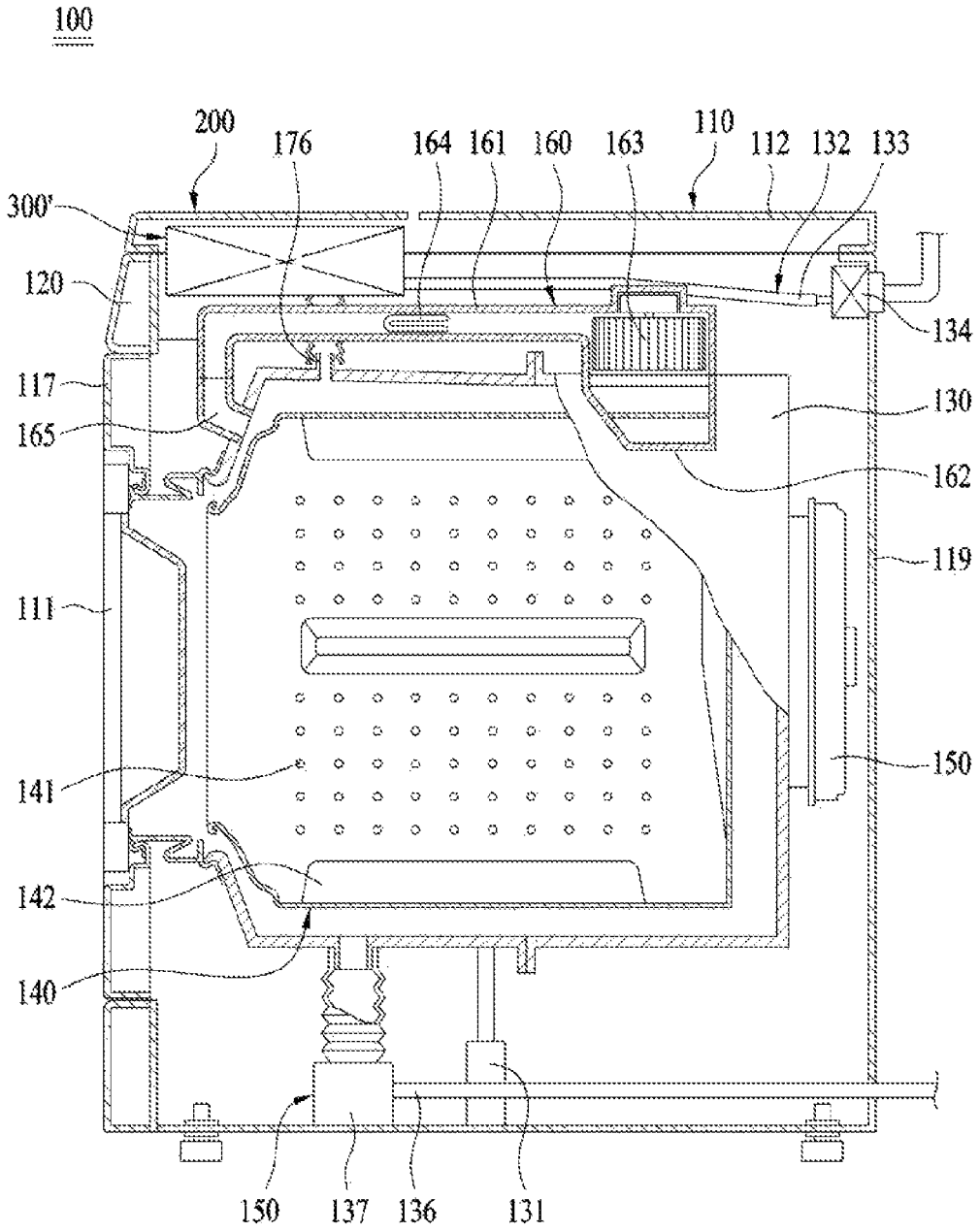
FIG. 2 is a schematic cross-sectional view showing a washing machine according to an exemplary embodiment of the present disclosure.
Figure 3:
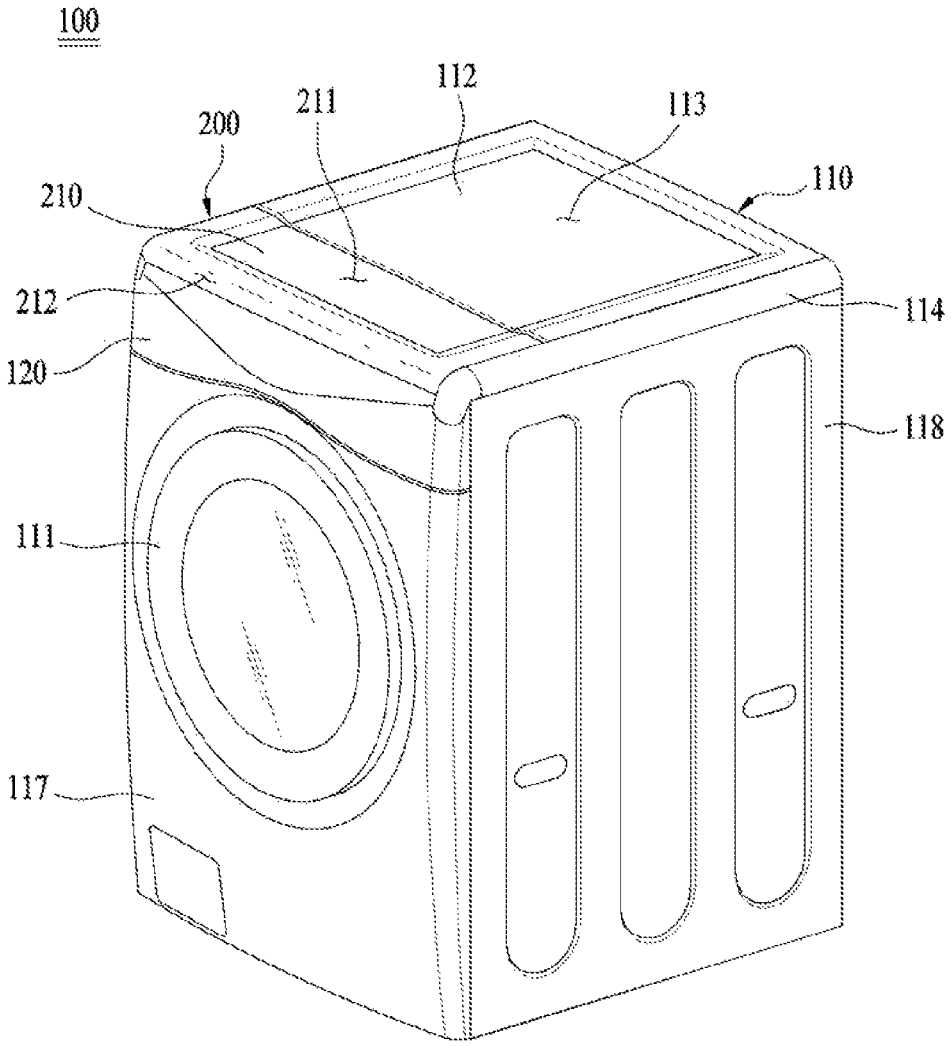
FIG. 3 is a perspective view showing the washing machine according to the embodiment of the present disclosure.

As shown in FIGS. 2 and 3, the washing machine 100 according to the embodiment of the present disclosure includes a cabinet 110, which includes an upper cover 112, a front cover 117, two side covers 118, and a rear cover 119 so as to create the appearance of the washing machine apparatus 100. The washing machine 100 further includes a tub 130, which is in the cabinet 110 to contain washing water, a drum 140 rotatably mounted in the tub 130, an air supply unit 160 for heating and circulating air inside the tub 130, a detergent dispenser 300', which is positioned over the front and upper part of the tub 130 to receive detergent when not covered by the upper cover 112, and a dispenser cover 200, which forms a continuous surface with the upper cover 112 and covers the detergent dispenser 300'.

The detergent dispenser 300' is mounted on the upper part of the cabinet 110 such that the detergent dispenser 300' is exposed by opening a portion of the upper part of the cabinet 110. In other words, the upper part of the cabinet 110 includes the upper cover 112, which forms a portion of the upper surface of the cabinet 110, and the dispenser cover 200 for shielding or exposing the detergent dispenser 300'.

The dispenser cover 200 defines the upper surface of the cabinet 110 and the front edge of the upper surface of the cabinet 110. The detergent dispenser 300', the dispenser cover 200, the sliding door 210, the recessed surface 211, and the connecting surface 212 will be described in detail below after the washing machine 100 is described.

The cabinet 110 is openably provided at the front face thereof with a door 111 for opening and closing the interior of the cabinet 110. A control panel 120 is on the upper part of the front surface through which a specific selection, for executing a washing procedure, a drying procedure or the like, is input.

The control panel 120 includes a manipulation part (not shown) which allows a user to select the washing and drying operations, and a display part (not shown) for displaying the procedures selected by the user and the state of operation of the washing machine 100.

The upper cover 112 of the cabinet 110 includes a recessed surface 113, which is depressed in the inner area of the upper cover 112 for the purpose of reinforcement, and a pair of side panels 114, which are each on two respective sides of the upper cover 112 so as to cover the gaps between the side covers 118 and the upper cover 112.

Although the door 111 and the control panel 120 have been described as being separated from each other, the door 111 and the control panel 120 may be integrally formed with each other. In other words, the manipulation part and the display part of the control panel 120 may be fitted into the door at a predetermined position thereof (preferably the upper part of the door) and may rotate with the door 111.

In this case, the outer surface of the door 111 may have a single curved surface or a single flat surface to provide the door 111 and the washing machine 100 with an aesthetically pleasing appearance.

The tub 130 is intended to contain washing water in the cabinet 110, and is provided at the rear part thereof with a motor 150 for rotating the drum 140. A spring (not shown) and a damper 131 are provided between the tub 130 and the cabinet 110 so as to support the tub 130 in a buffered manner.

The tub 130 is further provided with a water supply unit 132, which includes a water supply valve 134 and a water supply hose 133 for the supply of washing water, and a water discharge unit 135, which includes a water discharge pump 137 and a water discharge hose 136 for the discharge of washing water after the laundry washing operation is complete.

The water supply valve 134 of the water supply unit 132 may include valves for controlling the supply of hot water and cold water, respectively. Here, the valve for the supply of hot water is connected to a hot water supply line **135*d*** (as will be detailed further below).

In order to selectively supply cold water from a water supply source, the water supply valve 134 is preferably embodied as a 3-way valve or a 4-way valve. The water supply valve 134 can be connected to first and second water supply lines **135*a* and 135*b*, preliminary water supply line 135*c***, and the like.

All of the first and second water supply lines **135*a* and 135*b*, the preliminary water supply line 135*c*, and the hot water supply line 135*d* may be connected to the detergent dispenser 300' such that only water is supplied to the tub 130 through the detergent dispenser 300', or is mixed with liquid/powdered detergent, preliminary detergent, a bleaching agent, fabric softener and the like, the mixture being supplied to the tub 130**.

The functions of the water supply lines **135*c*, the first and second water supply lines 135*a* and 134*b* and the preliminary water supply line 134*c* will be described when the detergent dispenser 300'** is described.

The drum 140 is rotatably disposed in the tub 130, and laundry is introduced into the drum 140 through the door 111. The drum 140 has therein a plurality of draining holes 141 through which washing water is discharged, and is provided on the inner surface thereof with lifts 142, which lift the laundry contained in the drum 140 and then release the laundry so as to let it fall during the rotation of the drum 140. Consequently, it is possible to improve the washing performance by virtue of the vigorous motion of laundry by the lifts 142.

The air supply unit 160 serves to heat and circulate the air in the tub 130 so as to supply the heated air to the inside of the tub 130 and dry the laundry contained in the drum 140. The air supply unit 160 includes an introduction portion 162 through which the air in the tub 130 is introduced into the air supply unit 160, a blower fan 163, which is over the introduction portion 162 so as to draw air into the tub 130, a heater 164, for heating the air drawn in by the blower fan 163, and a discharge portion 165 for supplying the air, heated by the heater 164, to the inside of the drum 140.

The introduction portion 162 is positioned at the outer surface of the rear part of the tub 130 so as to allow the air in the tub 130 to be introduced therethrough, and the discharge portion 165 is connected to the center of the front part of the tub 130 so as to allow the air to be directly discharged to the inside of the drum 140.

The introduction portion 162 is connected to the discharge portion 165 via a duct 161 defining the path along which air flows. The heater 164 and the blower fan 163 are preferably disposed in the duct 161. The duct 161 is connected to both the discharge portion 165 and the introduction portion 162, and extends to the center of the front part from a portion of the rear part of the tub 130.

In consideration of the flow of air, it is preferable that the air discharged from the blower fan 163 be heated by the heater 164. The washing machine according to the present disclosure is constructed such that air is directly drawn in and heated from the outer surface of the tub 130 and is supplied to the front part of the tub 130. The humid air, which has been used to dry laundry, may be condensed on the inner surface of the tub 130, and may be converted into dry air due to the temperature difference between the inside of the tub 130 and the outside of the tub 130.

Alternatively, in order to convert humid air, which has been used to dry laundry, into dry air, some of the humid air in the tub 130 may be discharged to the outside of the tub 130, and dry air outside the tub 130 may be introduced into the tub 130.

Here, the components such as the tub 130, the drum 140, and the air supply unit 160 may be embodied as components such as a tub, drum, and air supply unit according to the conventional art, or components such as a tub, drum, and air supply unit which are improved over the conventional art.

In the operation of the washing machine 100, washing water is introduced into the tub 130 through the water supply unit 132, and washing, rinsing, and dehydration procedures are performed via rotation of the drum 140.

During washing and rinsing processes, the washing water is discharged to the outside through the water discharge unit 135. After the washing and rinsing processes, the laundry dehydration procedure is performed so as to complete the overall washing operation.

When the dehydration procedure is performed, the air in the tub 130 is circulated by means of the blower fan 163 of the air supply unit 160, and is heated by means of the heater of the air supply unit 160.

The heated air dries laundry contained in the drum 140 while circulating through the tub 130 and the air supply unit. Water in the air that has been used to dry the laundry condenses on the inner surface of the tub 130, due to the temperature difference between the inside and outside of the tub 130, and is discharged to the outside of the tub 130 through the water discharge unit 136.

Before or during the operation of the washing machine 100, detergent for washing can be introduced into the washing machine 100. In order to introduce detergent into the washing machine 100, the dispenser cover 200, which is at the upper part of the washing machine 100, has to be opened to allow liquid detergent, powdered detergent, fabric softener, subsidiary detergent and the like to be selectively introduced into the detergent dispenser 300'.

Hereinafter, the installation of the detergent receiver 300 and subsidiary detergent receiver 500 of the detergent dispenser 300' in the washing machine 100 according to the embodiment of the present disclosure will be described in detail with reference to the accompanying drawings.

Figure 4:
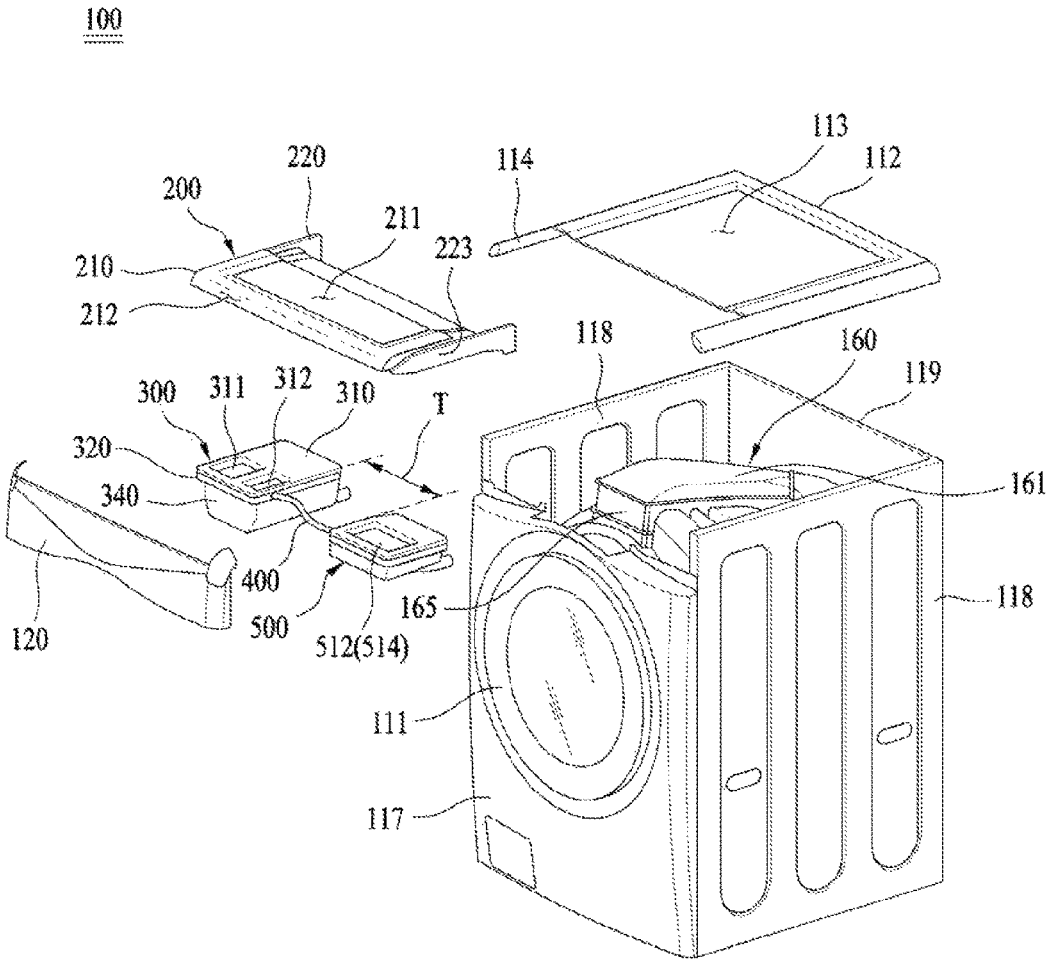
FIG. 4 is an exploded perspective view showing the upper structure of the washing machine according to the embodiment of the present disclosure.
Figure 5:
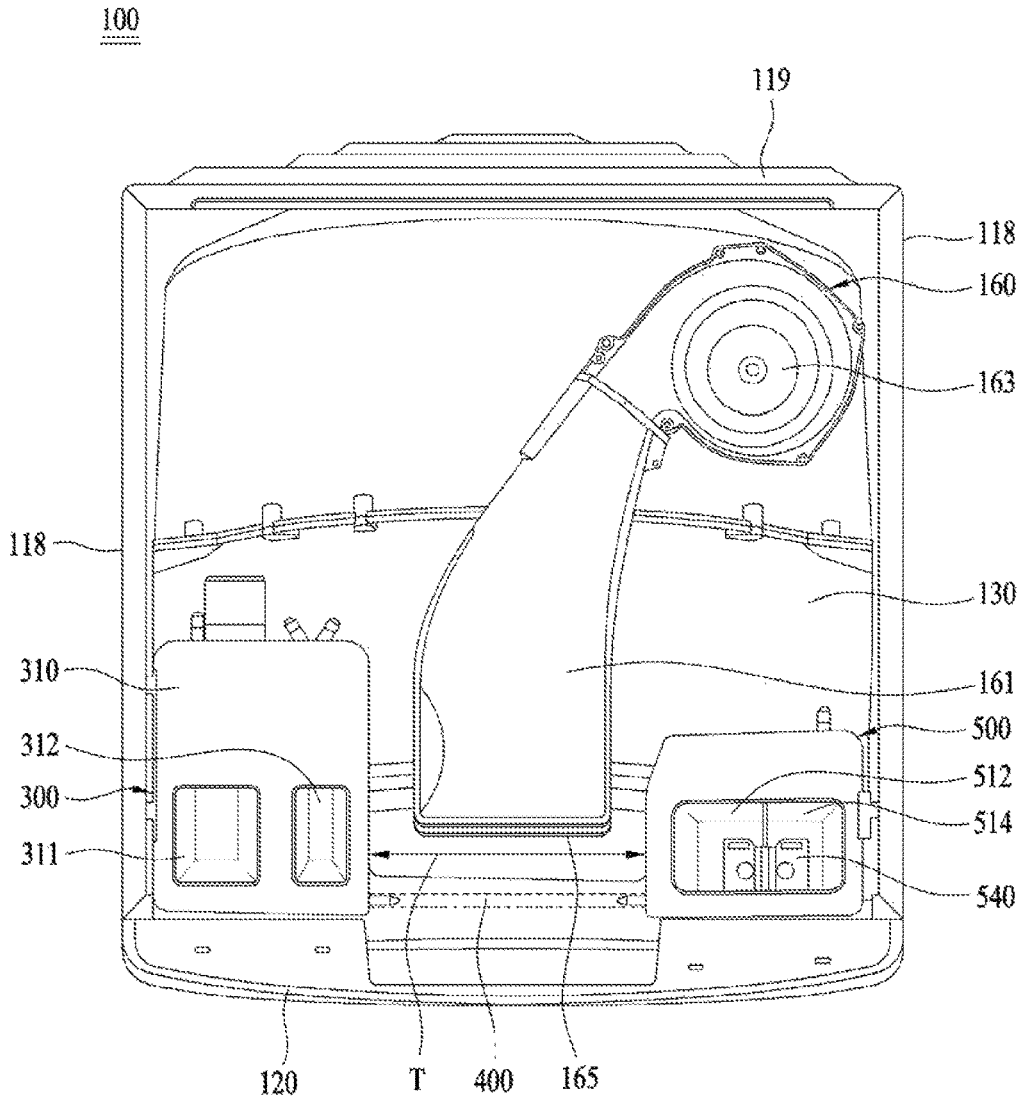
FIG. 5 is a plan view showing the internal structure of the washing machine according to the embodiment of the present disclosure.

As shown in FIGS. 4 and 5, the detergent dispenser 300' is positioned on the upper surface of the front part of the tub 130 in the cabinet 110, and is exposed by opening the dispenser cover 200.

The discharge portion 165, which is provided in the air supply unit 160 of the washing machine 100, is positioned at an upper portion of the front part of the tub 130, and the duct 161 of the air supply unit 160 extends to the discharge portion 165 from a portion of the rear part of the tub 130.

In order to prevent the detergent dispenser 300' from interfering with the discharge portion 165 or the duct 161 of the air supply unit 160, a detergent receiver 300 is provided at one side, deviating from the center of the front part of the tub 130, and a subsidiary detergent receiver 500 is spaced apart from the detergent receiver 300.

In other words, a space T is between the detergent receiver 300 and the subsidiary detergent receiver 500 so as to accommodate the discharge portion 165 or the duct 161 of the air supply unit 160.

Specifically, the detergent dispenser 300' includes the detergent receiver 300, which is at one side laterally deviating from the front end of the duct 161 and the discharge portion 165 of the air supply unit 160, and the subsidiary detergent receiver 500, which is at the opposite side laterally deviating from the front end of the duct 161 and the discharge portion 165.

Here, the detergent receiver 300 may receive powdered detergent (or liquid detergent) for washing laundry, preliminary detergent for removing stains from laundry, or the like, and the subsidiary detergent receiver 500 may receive a bleaching agent, fabric softener, or the like, which can be supplementary used to wash laundry.

The detergent receiver 300 is provided with a first tub-connecting hose 348 (described below), which is intended to supply the tub 130 with the mixture of the detergent or the preliminary detergent received therein and washing water additionally provided thereinto, and the subsidiary detergent receiver 500 is provided with a second tub-connecting hose 536 (described below), which is intended to supply the tub 130 with the mixture of the bleaching agent or fabric softener received therein and washing water additionally supplied thereinto.

Specifically, the detergent dispenser 300' is constructed such that the detergent receiver 300, into which powdered detergent (or liquid detergent) or preliminary detergent is introduced, is positioned on one side of a duct space T, and the subsidiary detergent receiver, into which a bleaching agent and/or fabric softener is introduced, is positioned on the opposite side of the duct space T. As a result, a user can clearly distinguish between the positions at which detergent and subsidiary detergent are introduced during a washing operation, thereby offering convenience to the user.

Hereinafter, the detergent dispenser 300' according to the embodiment of the present disclosure will be described in detail with reference to the accompanying drawings. The detergent dispenser 300' according to the embodiment of the present disclosure is divided into the detergent receiver 300 and the subsidiary detergent receiver 500, as described above. Accordingly, the detergent receiver 300 and the subsidiary detergent receiver 500 will be described separately from each other.

The detergent receiver 300 of the detergent dispenser 300' according to the embodiment of the present disclosure is first described in detail with reference to FIGS. 6 to 8.

Figure 6:
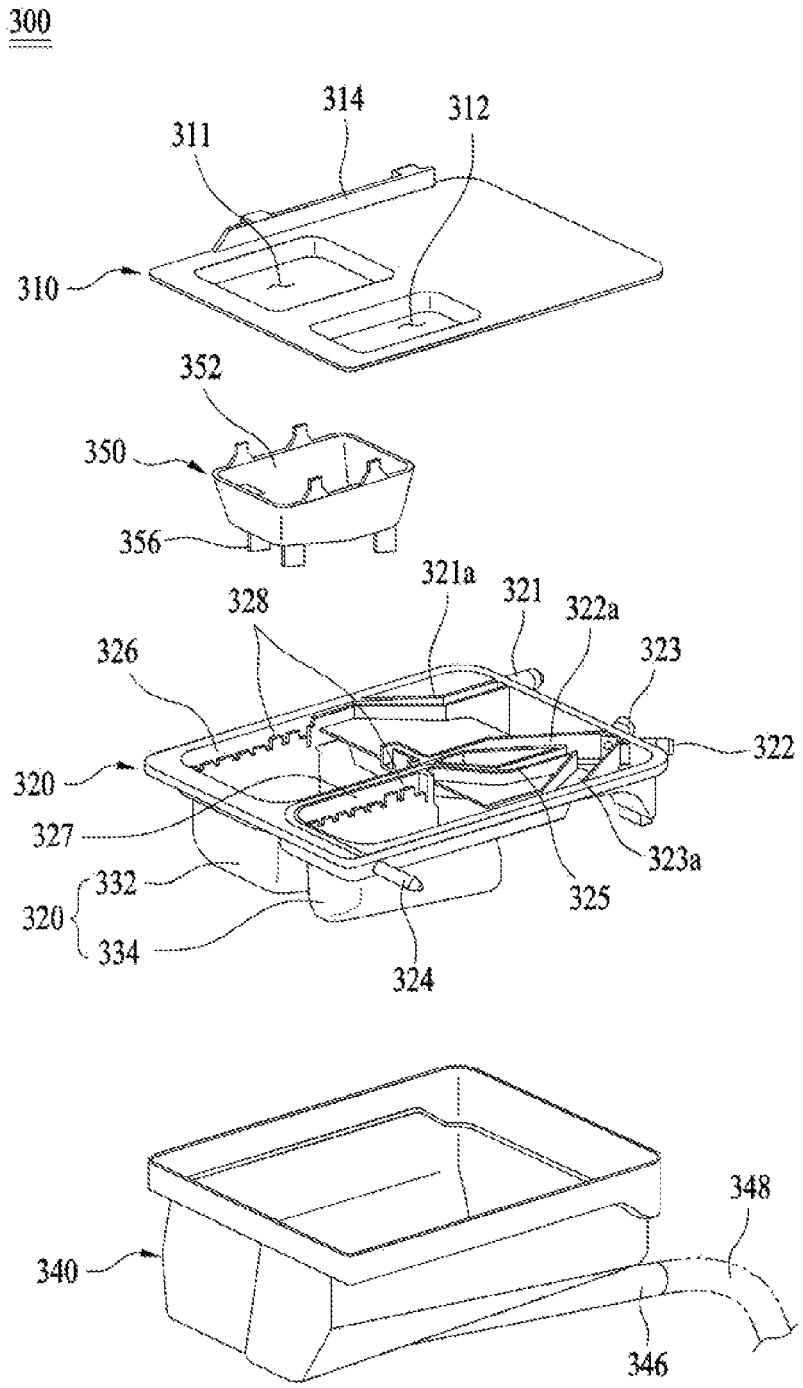
FIG. 6 is an exploded perspective view showing a detergent receiver of a detergent dispenser according to the embodiment of the present disclosure.
Figure 7:
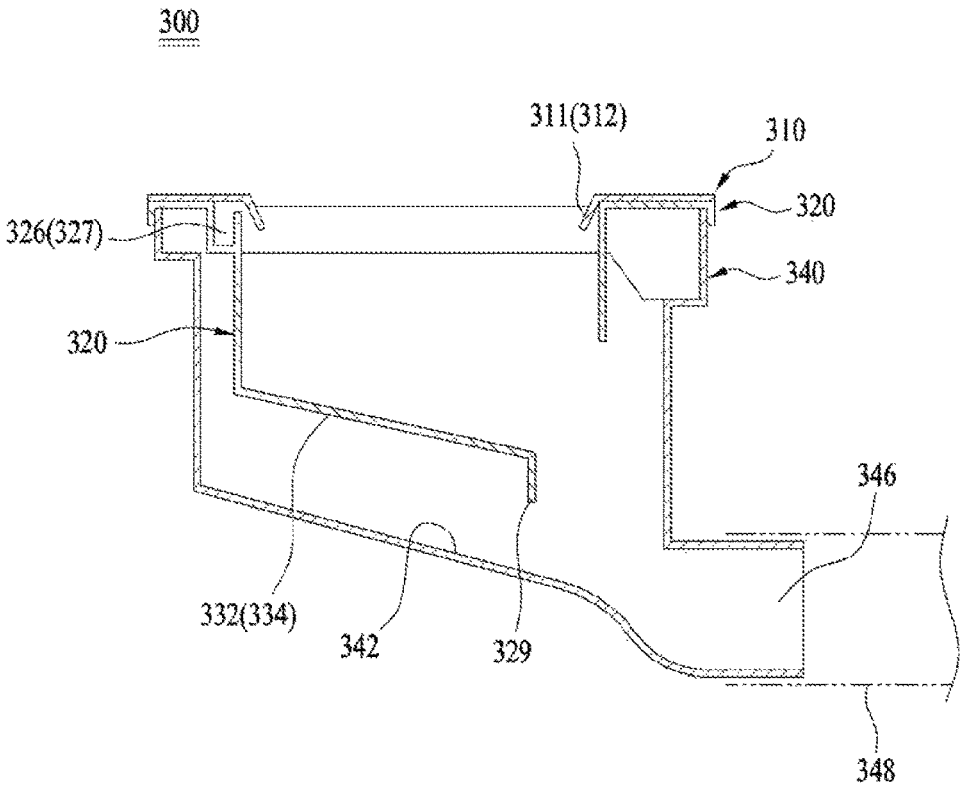
FIGS. 7 and 8 are cross-sectional views showing the detergent receiver of the detergent dispenser of the washing machine according to the embodiment of the present disclosure.

As shown in FIGS. 4 and 6, the detergent receiver 300 includes a first cover 310, having therein a detergent introduction hole 311 through which detergent is introduced, and a preliminary detergent introduction hole 312, through which preliminary detergent is introduced, a first flow channel part 320, which is disposed under the first cover 310 so as to contain detergent and preliminary detergent introduced thereinto and which supplies the contained detergent and preliminary detergent with water and mixes the detergent and preliminary detergent with the water, and a first water collector 340, for collecting the detergent and water (or the preliminary detergent and water), which were mixed with each other in the first flow channel part 320, and supplying the mixture to the tub 130.

The detergent receiver 300 may further include a liquid detergent introduction guide 350 for mixing liquid detergent with water and supplying the mixture to the tub 130 by virtue of a siphon phenomenon.

The first cover 310, the first flow channel part 320, and the first water collector 340 may be individually fabricated, and may be coupled to each other by means of additional coupling structures, or may be integrally coupled to each other.

As mentioned, the first cover 310, which forms the upper surface of the detergent receiver 300, has a detergent introduction hole 311 through which detergent is introduced, and a preliminary detergent introduction hole 312 through which preliminary detergent is introduced. It is preferable for the detergent introduction hole 311 and the preliminary detergent introduction hole 312 to be positioned close to each other, and to be configured to have different sizes or shapes so as to enable a user to easily distinguish between the two holes.

The first cover 310 is provided at one lateral side thereof with a coupler 314 which protrudes to allow the first cover 310, the first flow channel part 320, and the first water collector 340 to be coupled to the washing machine 100.

The first flow channel part 320 serves to contain detergent and preliminary detergent introduced thereinto and functions to provide a flow passage through which washing water and hot water, separately supplied thereto, flow so as to be mixed with detergent and preliminary detergent.

The first flow channel part 320 includes a detergent mixer 332, which is disposed under the detergent introduction hole 311 of the first cover 310 so as to contain detergent, and a preliminary detergent mixer 334, which is disposed under the preliminary introduction hole 312 of the first cover 310 so as to contain preliminary detergent.

The detergent mixer 332 and the preliminary detergent mixer 334 are inclined downward toward a first tub connector 346 of the first water collector 340, which will be described later, and the detergent mixer 332 and the preliminary detergent mixer 334 are provided at the ends thereof with respective drop protrusions 329 for assisting in discharging the mixed detergent and preliminary detergent (see FIGS. 7 and 8).

Furthermore, the first flow channel part 320 is provided at the rear part thereof with a first water supply connector 322, to which the first water supply line, through which washing water is supplied, is connected, a hot water supply line connector 321, to which the hot water supply line, through which hot water is supplied, is connected, and a preliminary water supply line connector 323, to which the preliminary water supply line, through which preliminary washing water is supplied, is connected.

The detergent mixer 332 is provided on the outer surface thereof with a first circulation flow channel 326 which extends along the outer surface of the detergent mixer 332 and through which washing water flows, and the first circulation flow channel 326 is provided on the inner surface thereof with a plurality of overflow protrusions 328 which allow washing water flowing through the first circulation flow channel 326 to overflow from the outer surface of the detergent mixer 332.

The overflow protrusions 328 are preferably configured to have different heights in the direction in which washing water flows through the first circulation flow channel 326.

The preliminary detergent mixer 334 is provided on the outer surface thereof with a second circulation flow channel 327, which extends along the outer surface of the detergent mixer 332 and through which washing water flows, and the second circulation flow channel 327 is provided on the inner surface thereof with a plurality of overflow protrusions 328 which allow washing water flowing through the second circulation flow channel 327 to overflow from the outer surface of the preliminary detergent mixer 334.

The overflow protrusions 328 are preferably configured to have different heights in the direction in which washing water flows through the second circulation flow channel 327.

The first flow channel part 320 is provided with a hot water flow channel 321*a* for guiding hot water supplied from the hot water supply line connector 321, a first water supply flow channel 322*a* for guiding washing water supplied from the first water supply line connector 322 and a preliminary water supply flow channel 323*a* for guiding preliminary washing water supplied from the preliminary water supply line connector 323.

The hot water flow channel 321*a* is connected to one end of the first circulation flow channel 326, which is formed on the outer surface of the detergent introduction hole 311, so as to allow hot water supplied from the hot water supply line connector 321 to flow into the first circulation flow channel 326, and the hot water supplied to the first circulation flow channel 326 is introduced into the detergent introduction hole 311 by virtue of the overflow protrusions 328 provided in the first circulation flow channel 326.

The first water supply flow channel 322*a* is connected to the other end of the first circulation flow channel 326 formed on the outer surface of the detergent introduction hole 311 so as to allow washing water supplied from the first water supply line connector 322 to flow into the first circulation flow channel 326, and the washing water supplied to the first circulation flow channel 326 is introduced into the detergent introduction hole 311 by virtue of the overflow protrusions 328 provided in the first circulation flow channel 326.

The preliminary water supply flow channel 323*a* is connected to one end of the second circulation flow channel 327, which is formed on the outer surface of the preliminary detergent introduction hole 312 so as to allow preliminary washing water supplied from the preliminary water supply line connector 323 to flow into the second circulation flow channel 327, and the washing water supplied to the second circulation flow channel 327 is introduced into the preliminary detergent introduction hole 312 by virtue of the overflow protrusions 328 provided in the second circulation flow channel 327.

The first water supply flow channel 322*a* and the preliminary water supply flow channel 323*a* intersect at a predetermined angle. A first subsidiary detergent water supply flow channel 325, which serves to guide washing water toward the subsidiary detergent receiver 500, is formed so as to centrally extend parallel to the direction in which water is supplied from the area at which the first water supply flow channel 322*a* and the preliminary water supply flow channel 323*a* intersect.

The first water collector 340 is coupled to the lower surface of the first flow channel part 320. The first water collector 340 is intended to supply various kinds of detergent, which are introduced into the detergent introduction hole 311 and the preliminary detergent introduction hole 312 in the first flow channel part 320, together with washing water to the tub 130.

The first water collector 340 is configured to have a box shape having an open upper face. The first water collector 340 is provided at a portion thereof with the first tub connector 346, through which detergent and washing water, which are collected from the first flow channel part 320, are discharged. The first tub connector 346 is connected to a portion of the tub 130 via the first tub-connecting hose 348. The first water collector 340 is provided on the lower surface thereof with a first sloped surface 342, which is inclined downward toward the first tub connector 346 (see FIGS. 7 and 8).

The detergent mixer 332 of the first flow channel part 320 may be provided with the liquid detergent introduction guide 350 for the introduction of liquid detergent. Specifically, when liquid detergent is introduced into the detergent mixer 332 of the first flow channel part 320 through the detergent introduction hole 311 in the first cover 310, the detergent mixer 332 has a problem in that the liquid detergent introduced thereinto may be supplied at an unwanted time because the liquid detergent is supplied immediately after being introduced, irrespective of the supply of washing water. Accordingly, in order to control the introduction of liquid detergent, it is necessary to provide the liquid detergent introduction guide 350, which is capable of supplying liquid detergent by virtue of a siphon phenomenon.

Figure 8:
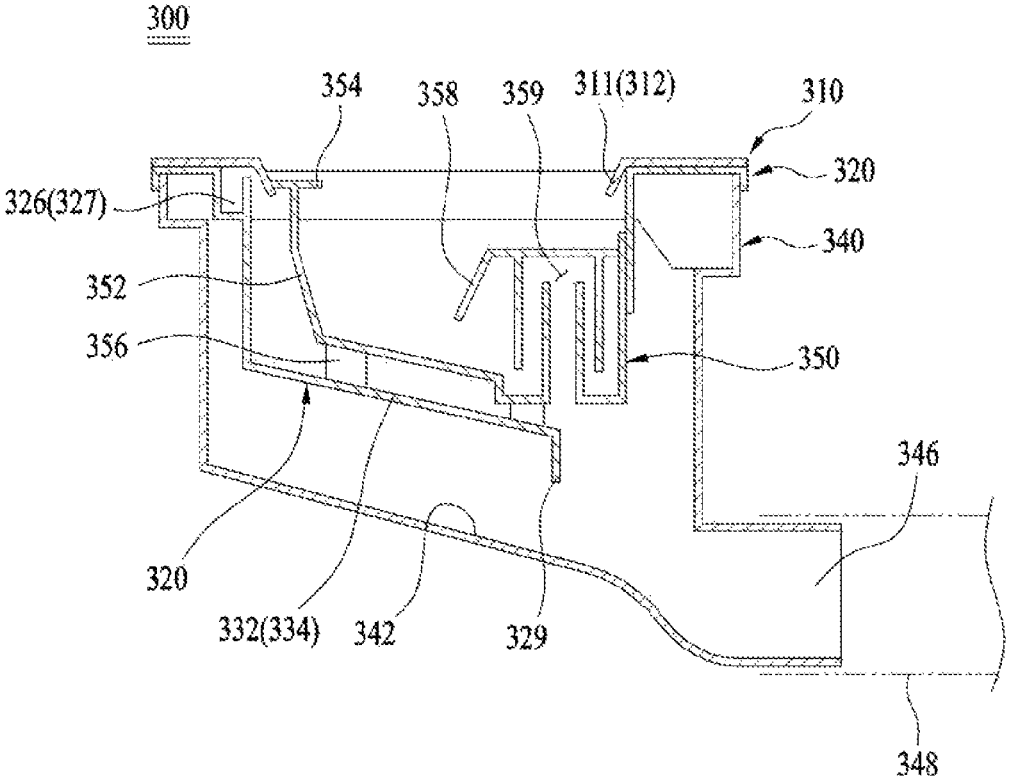

As shown in FIG. 8, the liquid detergent introduction guide 350 is removably mounted in the detergent mixer 332 of the first flow channel part 320. The liquid detergent introduction guide 350 includes a liquid detergent storage 352 for storing liquid detergent, and the liquid detergent storage 352 is provided therein with a liquid detergent siphon flow channel 359 for supplying liquid detergent stored in the liquid detergent storage 352 by virtue of a siphon phenomenon.

The liquid detergent storage 352 is provided at a portion thereof with a handle 354 by which the liquid detergent introduction guide 350 can be mounted or removed, and the liquid detergent siphon flow channel 359 is provided with an introduction-restricting protrusion 358 for limiting the introduction amount of liquid detergent that is introduced.

The liquid detergent introduction guide 350 is provided on the lower surface thereof with a plurality of support protrusions 356, which serve to support the liquid detergent introduction guide 350 when the liquid detergent introduction guide 350 is mounted in the detergent mixer 332.

Hereinafter, the subsidiary detergent receiver 500 of the detergent dispenser 300' according to the embodiment of the present disclosure will be described in detail with reference to FIGS. 9 and 10.

Figure 9:
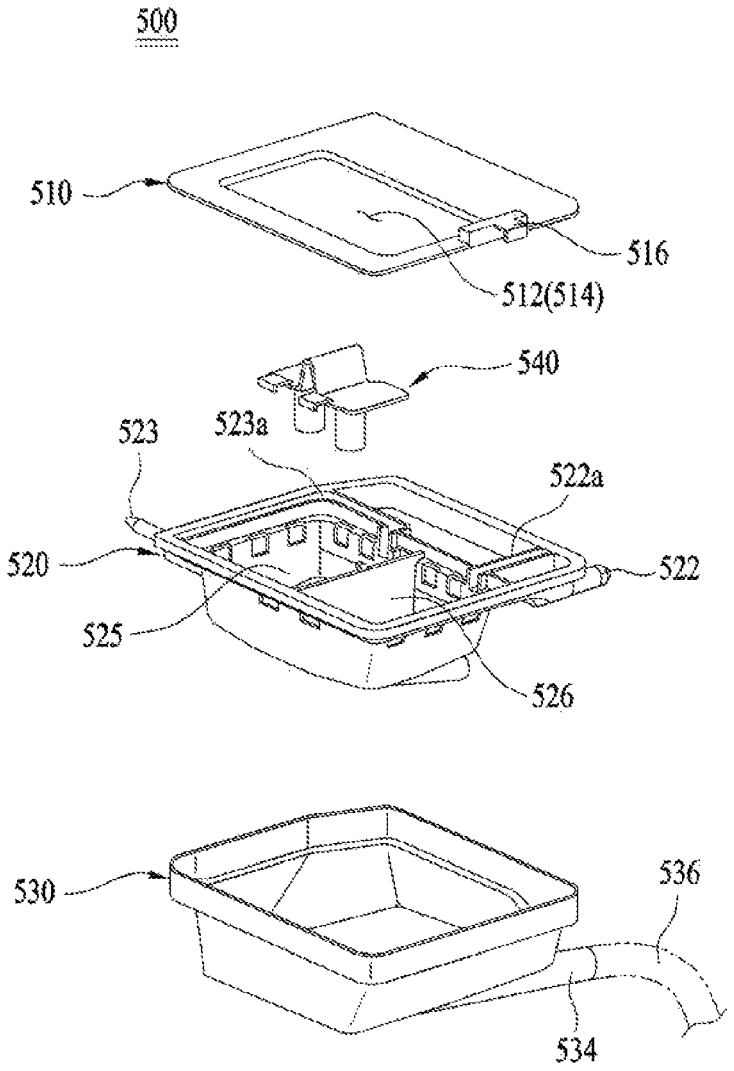
FIG. 9 is an exploded perspective view showing a subsidiary detergent receiver of the detergent dispenser according to the embodiment of the present disclosure.
Figure 10:
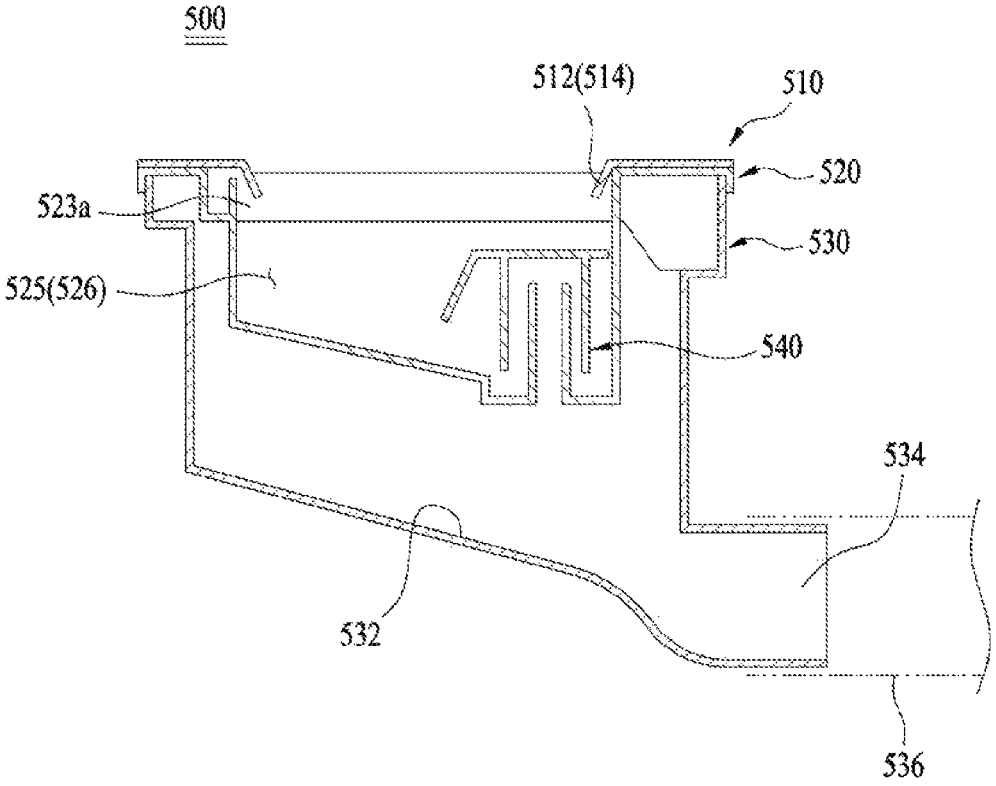
FIG. 10 is a cross-sectional view showing the subsidiary detergent receiver of the detergent dispenser according to the embodiment of the present disclosure.

As shown in FIG. 9, the subsidiary detergent receiver 500 includes a second cover 510 having therein a bleaching agent introduction hole 512 through which detergent (e.g. a bleaching agent, fabric softener or the like) is introduced, and a fabric softener introduction hole 514, through which fabric softener is introduced, a second flow channel part 520, which is positioned under the second cover 510 so as to contain bleaching agent and fabric softener introduced thereinto and which supplies the contained bleaching agent and fabric softener with water and mixes the bleaching agent and fabric softener with water, and a second water collector 530 for collecting the bleaching agent or fabric softener stored in the second flow channel part 520 and supplying the same to the tub 130.

The second cover 510, the second flow channel part 520, and the second water collector 530 may be individually fabricated, and may be coupled to each other by means of additional coupling structures, or may be integrally coupled to each other.

The second cover 510, which forms the upper surface of the subsidiary detergent receiver 500, has therein the bleaching agent introduction hole 512, through which a bleaching agent is introduced, and the fabric softener introduction hole 514, through which fabric softener is introduced.

Although the bleaching agent introduction hole 512 and the fabric softener introduction hole 514 may be formed separately from each other, the embodiment of the present disclosure is described as having a single hole into which both holes merge. The second cover 510 is provided at one lateral side thereof with a coupler 516 which protrudes so as to allow the second cover 510, the second flow channel part 520, and the second water collector 530 to be coupled to the washing machine 100.

The second flow channel part 520 serves to contain a bleaching agent and fabric softener introduced thereinto, and functions to provide a flow passage through which flows washing water, supplied either through the detergent receiver or separately.

The second flow channel part 520 includes a bleaching agent storage 525, which is disposed under the bleaching agent introduction hole 512 of the second cover 510 so as to store a bleaching agent, and a fabric softener storage 526, which is disposed under the fabric softener introduction hole 514 of the second cover 510 so as to store fabric softener.

The second flow channel part 520 is provided at the rear portion thereof with a second water supply line connector 522 to which the second water supply line, through which washing water is supplied, is connected, and a second flow channel connector 523 to which washing water supplied through the detergent receiver 300 is supplied.

The bleaching agent storage 525 and the fabric softener storage 526 are provided at the outer surfaces thereof with circulation flow channels and overflow protrusions, which are identical to those provided at the detergent mixer 332 and the preliminary detergent mixer 334 of the first flow channel part 320. Accordingly, the description of those components is omitted.

The second flow channel connector 523 of the second flow channel part 520 is connected to a first flow channel connector 324 of the detergent receiver 300 via an additional connecting hose 400 (see FIGS. 4 and 5). In other words, the subsidiary detergent receiver 500 may receive washing water either through the second water supply line or through the detergent receiver 300.

To this end, the second flow channel part 520 is provided with a second subsidiary detergent water supply flow channel **523*a*, which extends from the second flow channel connector 523 to the circulation flow channel of the bleaching agent storage 525 or the fabric softener storage 526**.

The second water supply connector 522 may also be provided with the second water supply flow channel **522*a*, which extends to the circulation flow channel of the bleaching agent storage 525 or the fabric softener storage 526 so as to guide washing water supplied through the second water supply line connector 522**.

The second water collector 530 is coupled to the lower surface of the second flow channel part 520. The second water collector 530 is intended to supply the tub 130 with various subsidiary detergents, which are introduced through the bleaching agent introduction hole 512 and the fabric softener introduction hole 514 in the second flow channel part 520, together with washing water supplied thereto.

The second water collector 530 is configured to have a box shape having an open upper face. The second water collector 530 is provided at a portion thereof with the second tub connector 534, through which detergent and washing water, which are collected from the second flow channel part 520, are discharged. The second tub connector 534 is connected to a portion of the tub 130 via the second tub-connecting hose 536. The second water collector 530 is provided on the lower surface thereof with a second sloped surface 532, which is inclined downward toward the second tub connector 534 (see FIG. 10).

Most bleaching agent and fabric softener is made of liquid-phase material. Since subsidiary detergents having a liquid phase may be supplied at an unwanted time, there exists a problem whereby the liquid subsidiary detergent is supplied immediately after it is introduced, irrespective of the supply of washing water.

Accordingly, in order to control the introduction of liquid detergent, the second flow channel part 520 is provided with a siphon flow channel part 540 for supplying liquid detergent by virtue of a siphon phenomenon. Since the siphon flow channel part 540 is constructed in the same manner as the liquid detergent introduction guide 350, which is described above, the description thereof is omitted.

Hereinafter, a procedure of supplying washing water in accordance with introduction of detergent and/or subsidiary detergent into the detergent receiver and the subsidiary detergent receiver will be described with reference to FIGS. 11 to 14.

Figure 11:
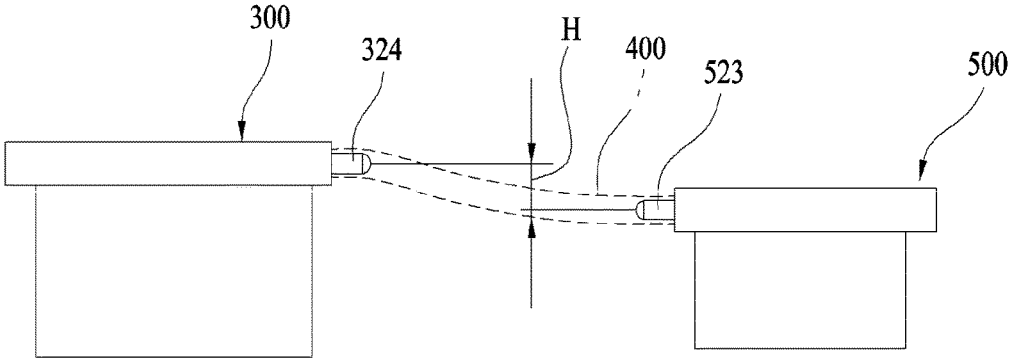
FIG. 11 is a schematic front view showing the installed state of the detergent dispenser according to the embodiment of the present disclosure.
Figure 12:
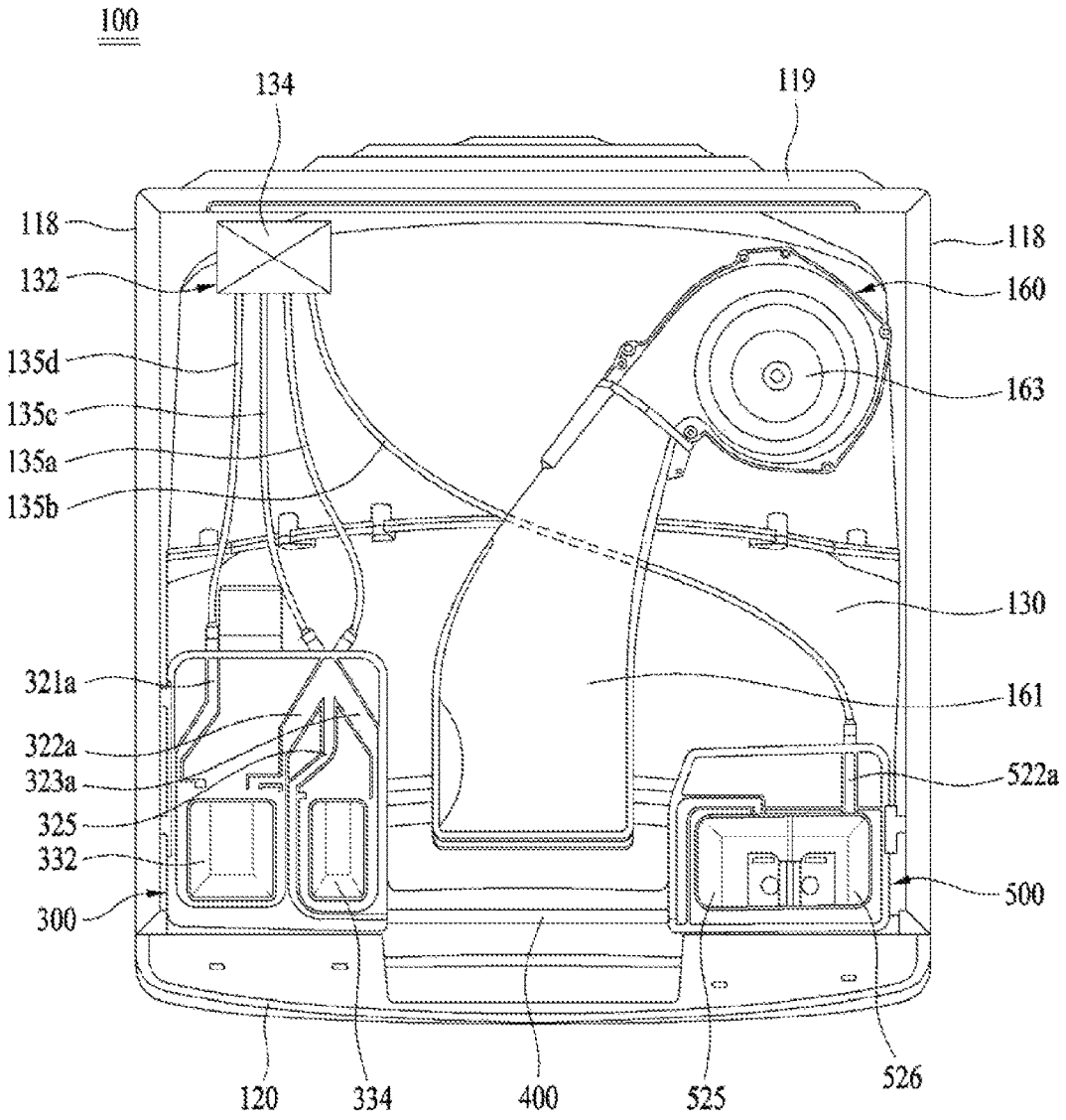
FIG. 12 is a plan view showing the connection between flow channels of the detergent dispenser according to the embodiment of the present disclosure.

As shown in FIGS. 11 and 12, the detergent receiver 300 and the subsidiary detergent receiver 500 are respectively installed between the two corners of the upper part of the cabinet 110 that creates the appearance of the washing machine 100 and both sides of the tub 130 disposed in the cabinet 11.

The subsidiary detergent receiver 500 may receive washing water through the detergent receiver 300. In connection therewith, the detergent receiver 300 and the subsidiary detergent receiver 500 are preferably positioned with a predetermined height difference H therebetween for the sake of efficient supply of washing water. In other words, the detergent receiver 300 is preferably installed at a higher level than the subsidiary detergent receiver 500.

According to the embodiment of the present disclosure, different water supply procedures are performed depending on the kind of detergent that is introduced. Accordingly, procedures of supplying washing water are described in accordance with introduced detergent (or subsidiary detergent).

Figure 13:
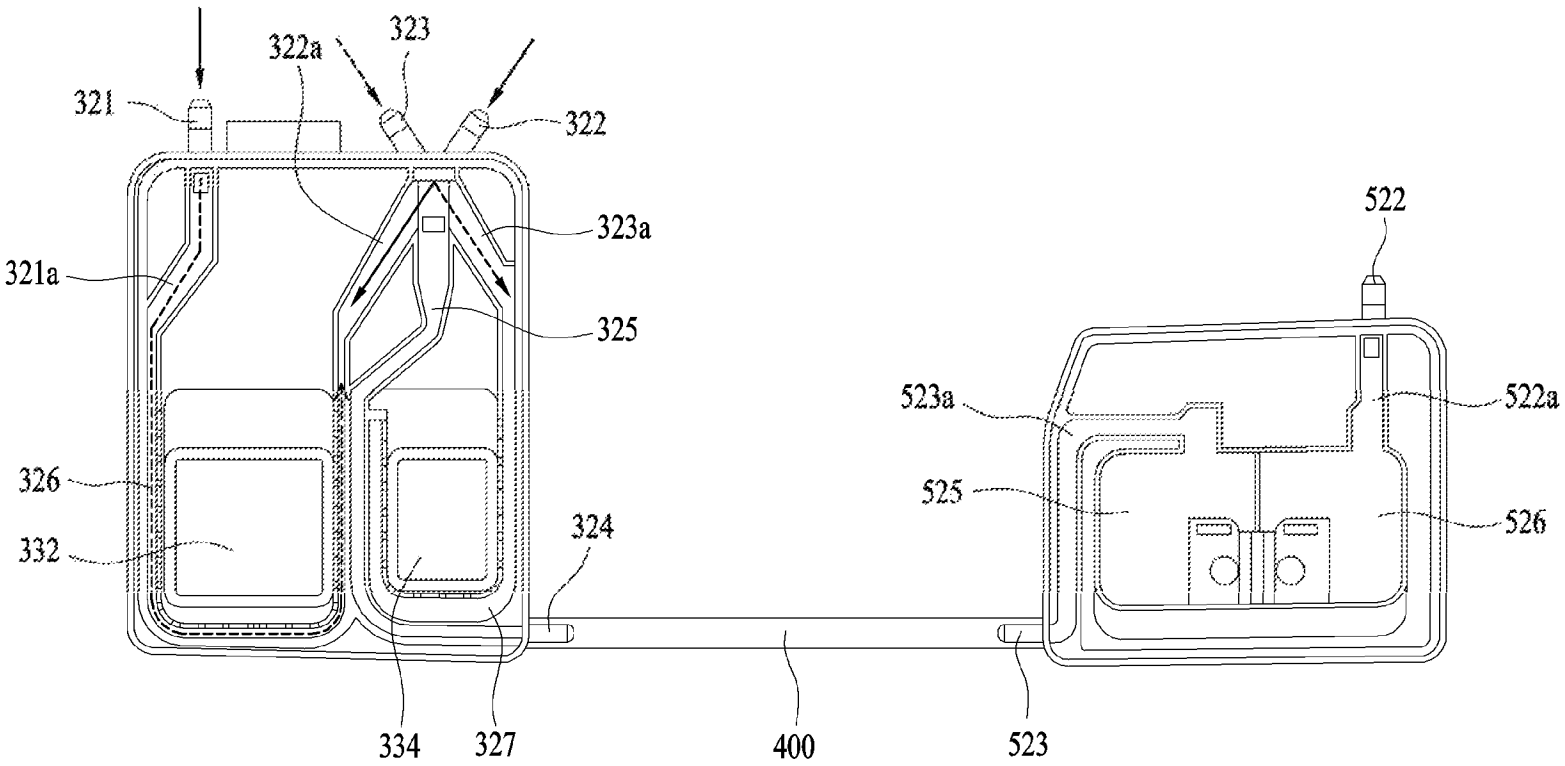
FIGS. 13 and 14 are schematic views showing the supply of washing water in the detergent dispenser according to the embodiment of the present disclosure.

In the case of general powdered detergent, with reference to FIG. 13, the powdered detergent is introduced into the detergent mixer 332 through the detergent introduction hole 311 in the detergent receiver 300 and is contained in the detergent mixer 332. At this time, washing water may be supplied through the first water supply line 135*a* or the hot water supply line 135*d*. Here, the water supply through the first water supply line 135*a* and the water supply through the hot water supply line 135*d* may be implemented concurrently, independently or alternately.

The washing water supplied to the first water supply line 135*a* is supplied through the first water supply line connector 322, to which the first water supply line 135*a* is connected. The supplied washing water is supplied to the detergent mixer 332 through the first water supply flow channel 322*a* and is mixed with the powdered detergent contained in the detergent mixer 332.

The mixed powdered detergent flows together with washing water into the first water collector 340 and is introduced into the tub 130 through the first tub-connecting hose 348 of the first water collector 340.

The hot water supplied to the hot water supply line 135*d* is supplied through the hot water supply line connector 321, to which the hot water supply line 135*d* is connected. The supplied hot water is supplied to the detergent mixer 332 through the hot water flow channel 321*a* and is mixed with the powdered detergent contained in the detergent mixer 332.

The mixed powdered detergent flows together with washing water into the first water collector 340*d* and is introduced into the tub 130 through the first tub-connecting hose 348 of the first water collector 340.

Meanwhile, preliminary detergent is introduced into the preliminary detergent mixer 334 through the preliminary detergent introduction hole 312 and is contained in the preliminary detergent mixer 334. At this time, washing water is supplied through the preliminary water supply line 135*c*.

The washing water supplied to the preliminary water supply line 135*c* is supplied through the preliminary water supply line connector 323, to which the preliminary water supply line 135*c* is connected. The supplied washing water is supplied to the preliminary detergent mixer 334 through the preliminary water supply flow channel 323*a* and is mixed with the preliminary detergent contained in the preliminary detergent mixer 334.

The mixed preliminary detergent flows together with washing water into the first water collector 340, and is introduced into the tub 130 through the first tub-connecting hose 348 of the first water collector 340.

In the case of liquid detergent, the liquid detergent introduced into the washing machine 100 may include various kinds of detergents in which case the procedure of supplying water may be the same as in the case of powdered detergent. Accordingly, the description of the procedure of supplying water in accordance with the introduction of liquid detergent is omitted.

Meanwhile, in the case of subsidiary detergent, such as a bleaching agent or fabric softener, the subsidiary detergent is introduced into the bleaching agent storage 525 (or the fabric softener storage 526) through the bleaching agent introduction hole 512 (or the fabric softener introduction hole 514) in the subsidiary detergent receiver 500, and is contained therein.

Figure 14:
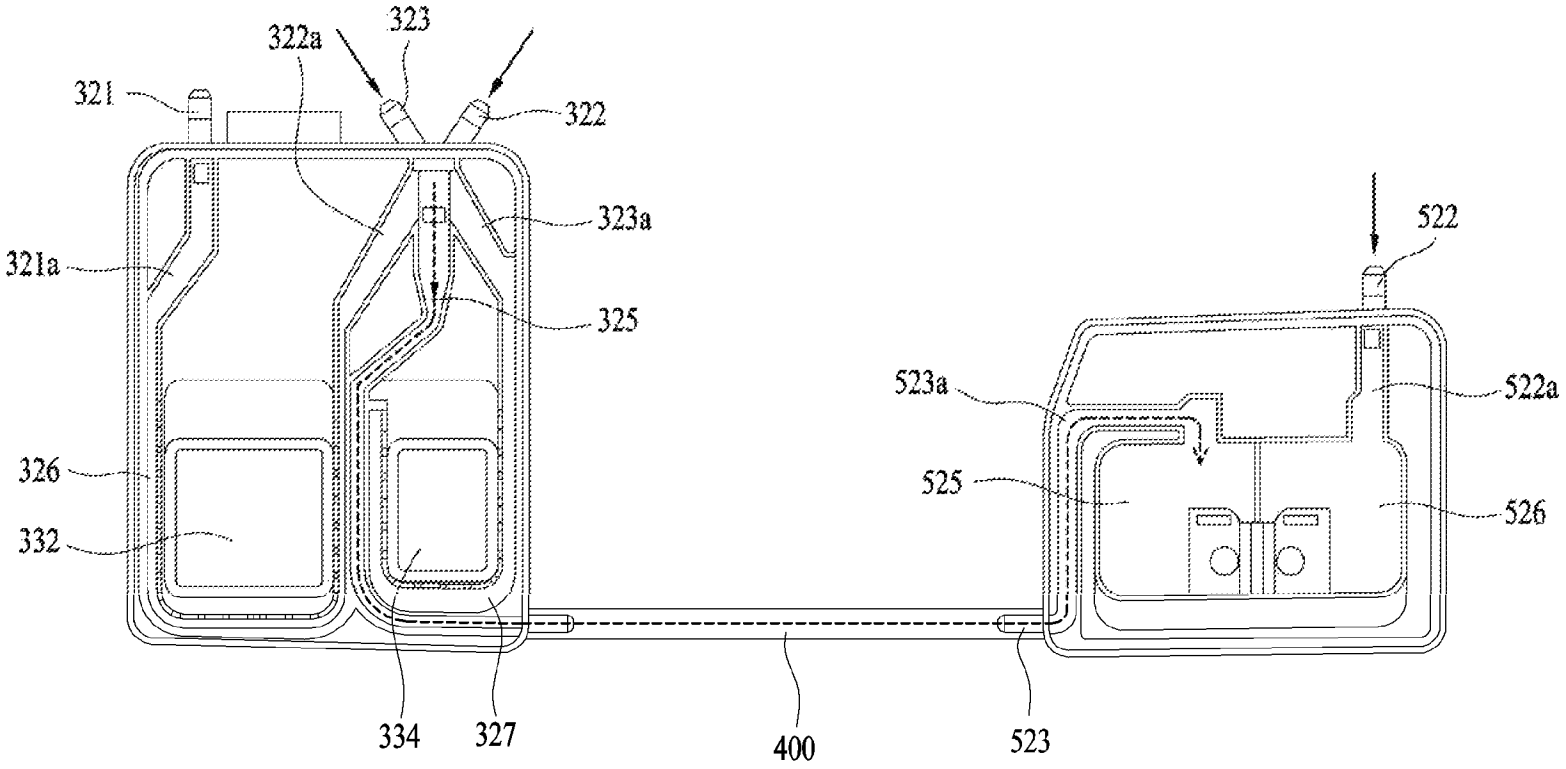

As illustrated in FIG. 14, the subsidiary detergent receiver 500 may receive washing water through the detergent receiver 300. At this time, washing water is supplied through both the first water supply line 135*a* and the preliminary water supply line 135*c*, which are connected to the detergent receiver 300.

The first water supply flow channel 322*a*, through which washing water supplied from the first water supply line 135*a* flows, and the preliminary water supply flow channel 323*a*, through which washing water supplied from the preliminary water supply line 135*c* flows, intersect each other. The first subsidiary detergent water supply flow channel 325 is formed so as to extend between the first water supply flow channel 322*a* and the preliminary water supply flow channel 323*a* and parallel to the direction in which is supplied from the area at which the first water supply flow channel 322*a* and the preliminary water supply flow channel 323*a* intersect.

Specifically, when washing water is supplied through both the first water supply flow channel 322*a* and the preliminary water supply flow channel 323*a*, the washing water supplied through both the first water supply flow channel 322*a* and the preliminary water supply flow channel 323*a* collide with each other at the intersection between the first water supply flow channel 322*a* and the preliminary water supply flow channel 323*a*, and then flow through the first subsidiary detergent water supply flow channel 325, which is centrally formed between the first water supply flow channel 322*a* and the preliminary water supply flow channel 323*a*, without flowing through the first water supply flow channel 322*a* and the preliminary water supply flow channel 323*a*.

The washing water, which flows into the first subsidiary detergent water supply flow channel 325, flows into the subsidiary detergent receiver 500 through the connecting hose 400 connected to the first flow channel connector 324, and then flows into the second water supply flow channel 523*a* connected to the second flow channel connector 523 of the subsidiary detergent receiver 500.

The washing water, which flows into the second water supply flow channel 523*a*, flows into the second water collector 530 through the siphon flow channel part 540, together with a bleaching agent (or fabric softener) contained in the bleaching agent storage 525 (or the fabric softener storage 526), and is then introduced into the tub 130 through the second tub-connecting hose 536 connected to the second water collector 530.

Hereinafter, the dispenser cover according to the embodiment of the present disclosure is described in detail with reference to FIGS. 15 to 19.

The dispenser cover 200, which slides into the washing machine 100 so as to open and close the detergent dispenser 300', is provided over the front part of the upper surface of the washing machine 100 (particularly, over the detergent dispenser 300').

The upper cover 112 and the dispenser cover 200 collectively form the upper surface of the washing machine 100 and extend so as to be continuous with each other, thereby offering a sense of unity.

In other words, the dispenser cover 200, which is disposed to be adjacent to the upper cover 112, forms a surface that is continuous with the upper surface of the upper cover 112.

The dispenser cover 200 defines the front part of the upper surface of the washing machine 100 and extends so as to be continuous with the front cover 117 of the washing machine 100. In other words, the dispenser cover 200 forms part of the upper surface of the washing machine 100, and connects the upper surface and the front surface of the washing machine 100 via a connecting surface extending to the front cover 117 of the washing machine 100, thereby offering an aesthetically pleasing appearance.

The pair of side panels 114, which are positioned on both lateral sides of the upper cover 112, extend toward the dispenser cover 200 so as to complete the appearance of both lateral sides of the upper cover 112 and the dispenser cover 200.

Figure 15:
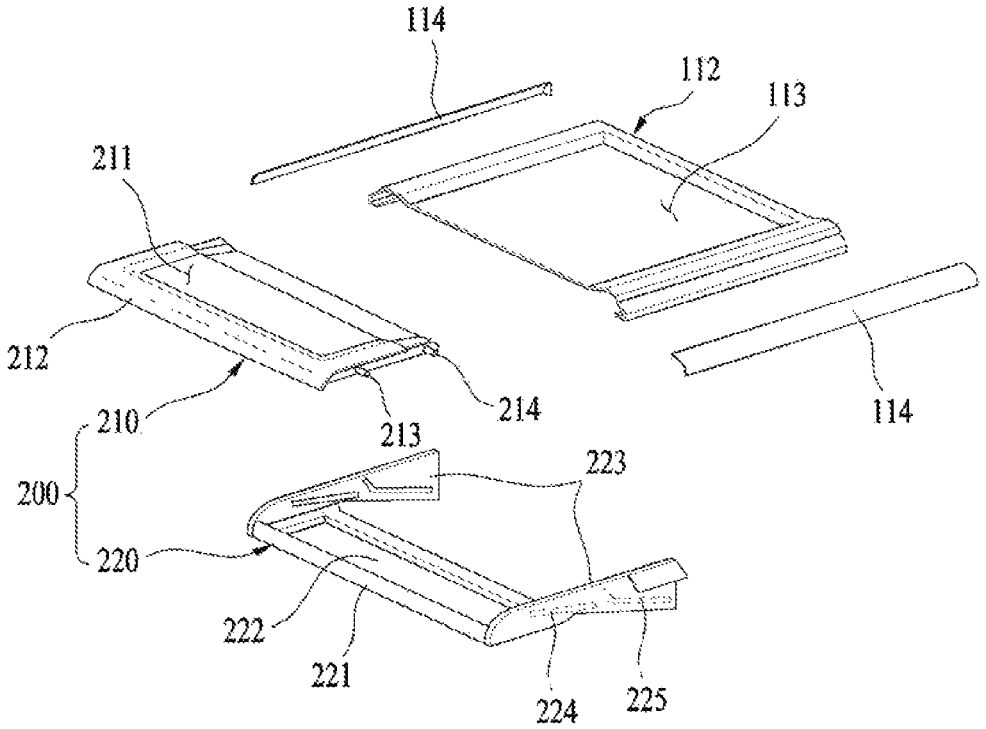
FIG. 15 is an exploded perspective view showing an upper panel and a dispenser cover of the washing machine according to the embodiment of the present disclosure.

As shown in FIG. 15, the dispenser cover 200 according to the embodiment of the present disclosure includes a door bracket 220, which is disposed over the detergent dispenser 300' installed inside the washing machine 100, and a sliding door 210, which is guided by the door bracket 220 and is moved to a position under the upper cover 112 so as to open the detergent dispenser 300' when the sliding door 210 is opened.

The detergent dispenser 300' and the upper cover 112 are spaced apart from each other by a predetermined distance so as to allow the sliding door 210 of the dispenser cover 200 to be easily moved without interference.

The sliding door 210 is positioned at the upper surface of the front part of the washing machine 100 and is positioned in front of the upper cover 112 so as not to be covered by the upper cover 112. The outer surface of the sliding door 210 is flush with the upper surface of the upper cover 112.

Specifically, the upper cover 112 is provided at the upper surface thereof with the recessed surface 113 for reinforcing the upper cover 112, and the sliding door 210 is provided at the upper surface thereof with a recessed surface 211, which is flush with the recessed surface 113 of the upper cover 112. Accordingly, the upper surface of the washing machine 100 exhibits a single recessed shape composed of the recessed surface 113 of the upper cover 112 and the recessed surface 211 of the sliding door 210.

The sliding door 210 is provided at the center of the front part thereof with a handle 215, which is recessed so as to make it convenient to use the sliding door 210. A mounting recess 216, into which a push lever 233 of a lock unit 230, which will be described later, is installed, is provided inside the handle 215.

The front edge of the sliding door 210 is provided with the connecting surface 212, which is continuous with the contour of the front cover 117 of the cabinet 110. In other words, the front edge of the sliding door 210 constitutes the front and upper edge of the washing machine 100.

That is, the sliding door 210 may be provided at the front edge thereof with the connecting surface 212 having a predetermined curved shape, and the upper surface of the sliding door 210 may be continuous with the front surface of the front cover 117 via the curved surface of the connecting surface 212.

Alternatively, the connecting surface 212 of the sliding door 210 may include an inclined surface having a predetermined angle of inclination. If the front edge of the sliding door 210 has an inclined surface, the front edge of the washing machine 100 may include three flat or curved surfaces, namely the door 210, the connecting surface 212, and the front cover 117.

The sliding door 210 is provided at both lateral sides thereof with first and second sliding protrusions 213 and 214, which are guided by the door bracket 220, which will be described later. The first and second sliding protrusions 213 and 214 are spaced apart from each other by a predetermined distance, and the second sliding protrusion 214 is positioned behind the first sliding protrusion 213.

The door brackets 220 include a body part 221, which is disposed over the detergent dispenser 300', and guide parts 223, which are disposed on both lateral sides of the body part 221 so as to slidably guide the sliding door 210.

The body part 221 has one or more through holes 222 corresponding to the detergent introduction hole 311, the preliminary detergent introduction hole 312, the subsidiary detergent introduction hole 512 and the like, which are formed in the detergent dispenser 300'.

The pair of guide parts 223 are vertically disposed at both lateral side ends of the body part 221 and extend downward from the upper cover 112. The guide parts 223 are provided in facing surfaces thereof with the first and second guide slits 224 and 225, along which the first and second sliding protrusions 213, inserted therein, are guided.

The first and second guide slits 224 and 225 are symmetrically formed in the inner surfaces of the pair of guide parts 223. The first guide slit 224 is positioned in front of the second guide slit 225.

The first guide slit 224 and the second guide slit 225 have different angles of inclination, and are inclined downward in the direction of the upper cover 112. The second guide slit 225 preferably has a greater angle of inclination than the first guide slit 224.

The first sliding protrusion 213 is inserted into the first guide slit 224, and the second sliding protrusion 214 is inserted into the second guide slit 225. Accordingly, when the sliding door 210 slides, the first and second sliding protrusions 213 and 214 move along the first and second guide slits 224 and 225, respectively.

The first guide slit 224 and the second guide slit 225 have different angles of inclination. The upper ends of the first and second guide slits 224 and 225 extend such that the sliding door 210 closes the detergent dispenser 300' when the first and second sliding protrusions 213 and 214, inserted into the first and second guide slits 224 and 225, are positioned at the upper ends of the first and second slits 224 and 225.

The lower ends of the first and second guide slits 224 and 225 extend such that the sliding door 210 opens the detergent dispenser 300' and moves to a position under the upper cover 112 when the first and second sliding protrusions 213 and 214, inserted into the first and second guide slits 224 and 225, are positioned at the lower ends of the first and second guide slits 224 and 225.

There may be a problem with the dispenser cover 200 in that the sliding door 210 may be opened without user intention. In other words, because the first and second guide slits 224 and 225 formed in the guide parts 223 of the door bracket 220 are inclined downward toward the direction in which the sliding door 210 is opened, the sliding door 210 of the dispenser cover 200 may require the lock unit 230. Accordingly, the sliding door 210 is provided with the lock unit 230 for preventing the sliding door 210 from being opened or closed unintentionally.

Figure 16:
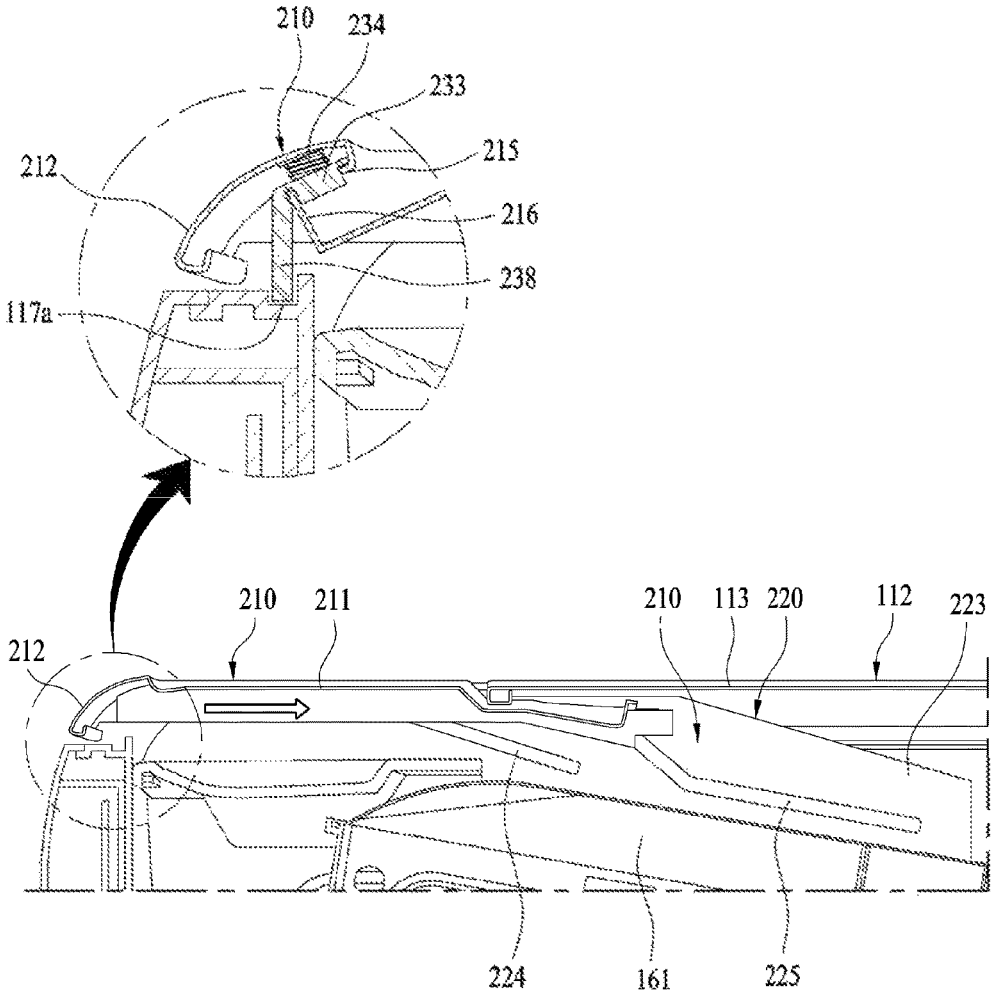
FIGS. 16 and 17 are partial cross-sectional views showing the dispenser cover according to the embodiment of the present disclosure.
Figure 17:
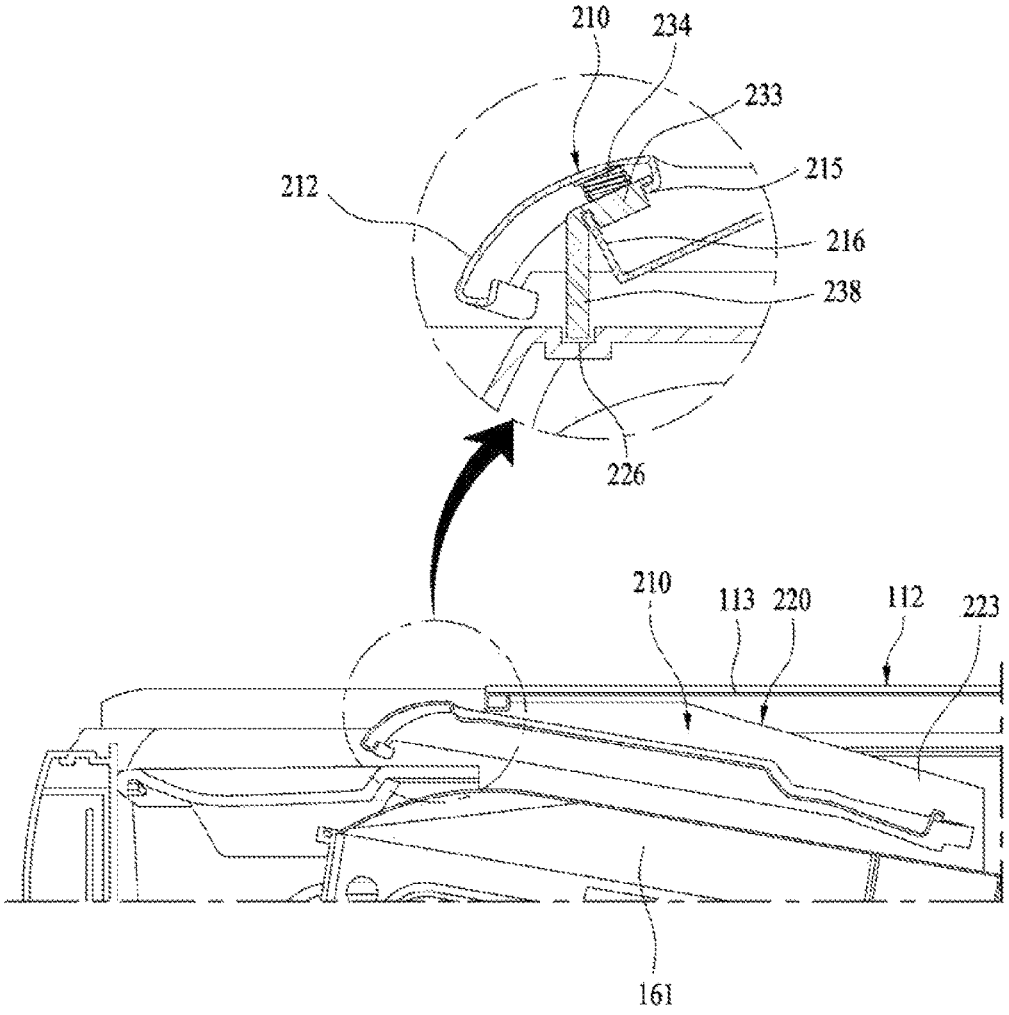
Figure 18:
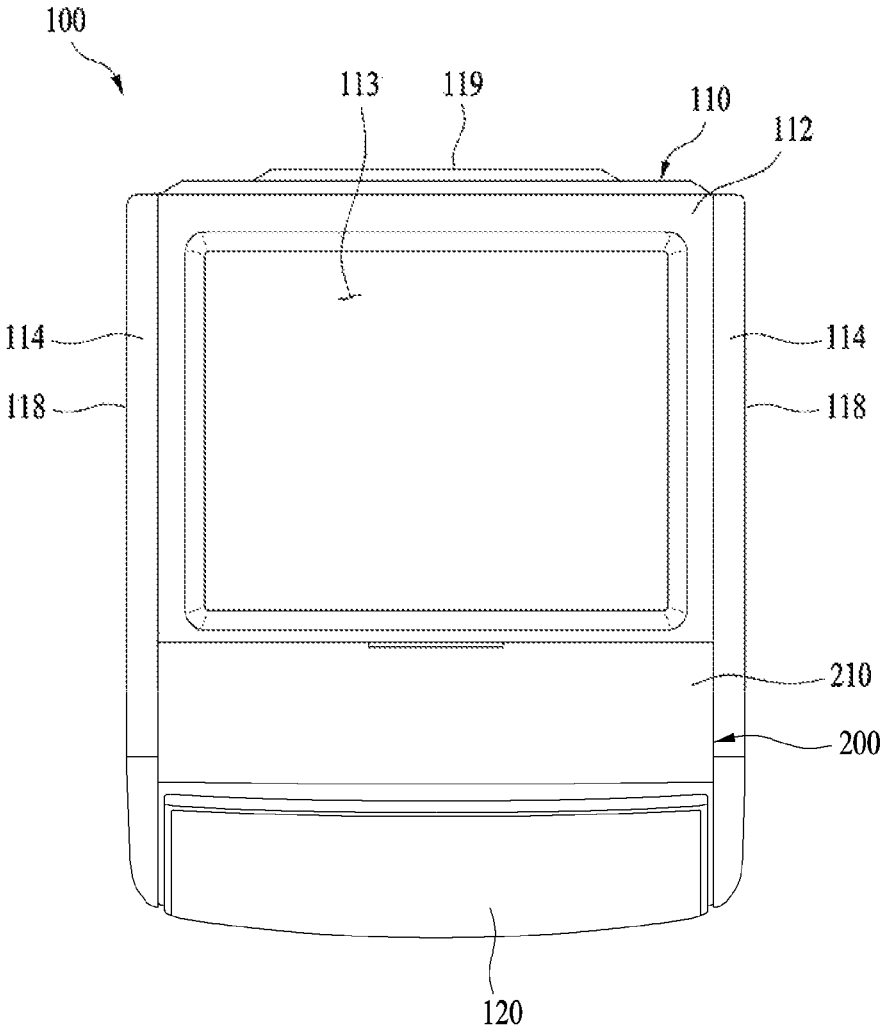
FIGS. 18 and 19 are plan views showing the operation of the dispenser cover according to the embodiment of the present disclosure.
Figure 19:
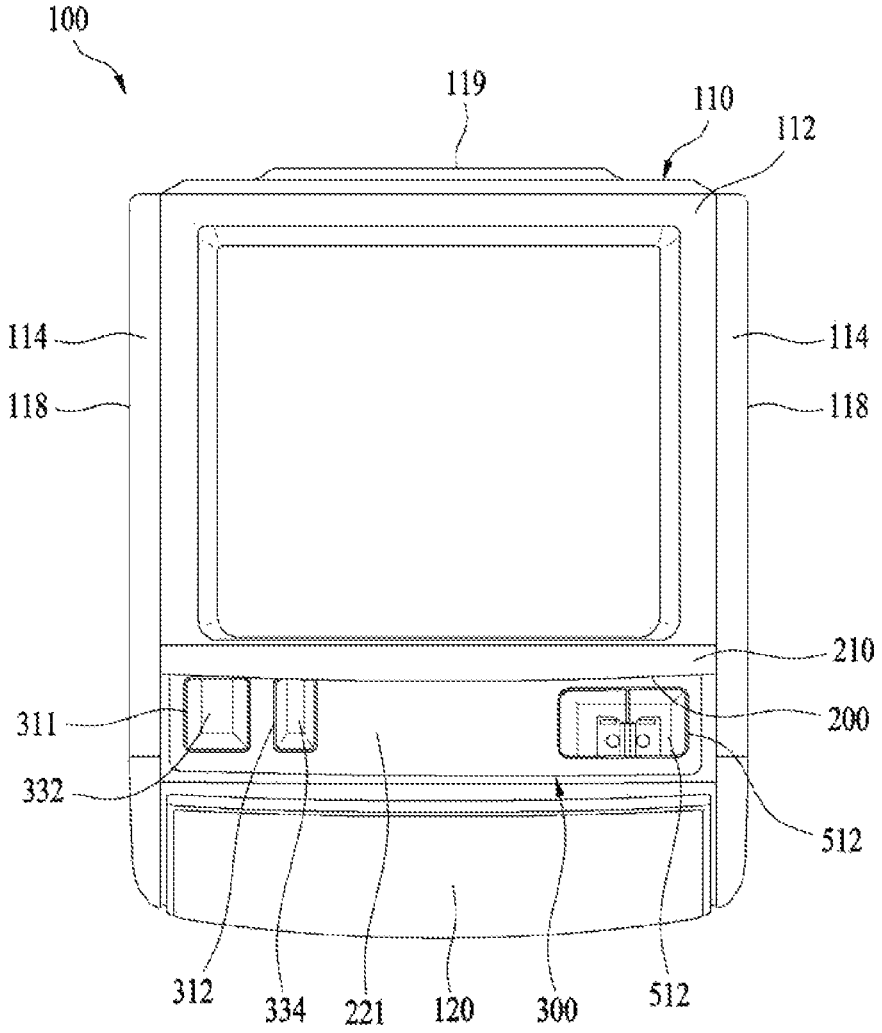

As shown in FIGS. 16 and 17, the lock unit 230 includes the push lever 233, which is movably inserted in the mounting recess 216 formed inside the handle of the sliding door 210 so as to control the locked state of the door 210, and a return spring 234 for providing the elastic force required to maintain the push lever 233 in a normal state.

The push lever 233 is coupled to the mounting recess 216 formed in the handle of the sliding door 210 so as not to be separated therefrom, and is biased outwards by means of the return spring 234 provided in the handle 215.

The push lever 233 is provided with a locking protrusion 238, which extends from the push lever 233 and is bent at a predetermined angle. The locking protrusion 238 is fitted into a first locking groove 226, formed in the upper surface of the rear end of the door bracket 220, and a second locking groove 117*a*, formed in the upper end of the front cover 117, so as to maintain the sliding door 210 in a locked state.

Hereinafter, the operation of the dispenser cover 200 according to an embodiment of the present disclosure will now be described with reference to FIGS. 16 to 19.

In the initial state of the dispenser cover 200, the dispenser cover 200 closes the detergent dispenser 300'.

In other words, the sliding door 210 of the dispenser cover 200 is removed from the position under the upper cover 112 and is positioned over the detergent dispenser 300'.

At this time, the first and second sliding protrusions 213 and 214, which are formed on both lateral sides of the sliding door 210, are positioned at the upper ends of the first and second guide slits 224 and 225, which are formed in the guide parts 223 of the door bracket 220, and the front edge of the sliding door 210 constitutes the front and upper edge of the washing machine 100.

In order to open the detergent dispenser 300', the push lever 233 of the lock unit 230, which is provided at the handle 215 of the sliding door 210, is pushed so as to release the locked state of the lock unit 230.

In other words, when the push lever 233 is pushed by a user in order to open the sliding door 210, the locking protrusion 238 provided at the push lever 233 is moved together with the push lever 233 and is thus separated from the second locking groove 117*a*, thereby releasing the locked state of the sliding door 210.

When the sliding door 210 is pushed toward the upper cover 112 while the push lever 233 of the lock unit 230 is pushed, the first and second sliding protrusions 213 and 214 of the sliding door 210 are moved along the first and second guide slits 224 and 225 formed in the guide parts 223 of the door bracket 220, whereby the sliding door 210 is moved.

Here, the first and second guide slits 224 and 225 are configured to be inclined downward as they move toward the upper cover 112. Accordingly, as the sliding door 210 moves to a position under the upper cover 112, the detergent dispenser 300' is opened.

As the sliding door 210 is opened, the push lever 233 of the lock unit 230, which is provided at the sliding door 210, is moved toward the rear end of the door bracket 220, and is fitted into the first locking groove 226 formed in the door bracket 220, thereby restricting the closing movement of the sliding door 210. Thereafter, in order to close the sliding door 210, the sliding door 210 is pushed forward while the push lever 233 of the lock unit 230 is pushed.

In the washing machine 100 according to the embodiment of the present disclosure, since the detergent dispenser 300' is positioned on the upper part of the washing machine 100 and the dispenser cover 200, adapted to open and close the detergent dispenser 300', is provided on the upper surface of the washing machine 100, it is possible for a user to more easily introduce detergent into the washing machine 100.

In the washing machine 100 according to the embodiment of the present disclosure, since the detergent receiver of the detergent dispenser 300' is separated from the subsidiary detergent receiver 500, it is possible to offer more prominent visibility to a user, thereby making the introduction of detergent and subsidiary detergent more convenient.

In addition, since the upper cover 112 and the dispenser cover 200, which form the upper surface of the washing machine 100, are configured so as to be continuous with each other, the upper surface of the washing machine 100 can appear as an integral component having a neat appearance.

As is apparent from the above description, the washing machine according to the present disclosure is characterized in that the position of the detergent dispenser is changed and the structure is improved, thereby allowing a user to easily introduce detergent into the washing machine.

Furthermore, because the washing machine according to the present disclosure is improved with respect to the position and structure of the detergent dispenser, it is possible to eliminate mechanical restrictions relating to the design of the washing machine.

In addition, since the opening and closing action of the door for opening and closing the detergent dispenser is restricted, it is possible to prevent unintentional opening of the door.

It will be apparent to those skilled in the art that various modifications and variations can be made in the present disclosure without departing from the spirit or scope of the disclosure. Thus, it is intended that the present disclosure covers the modifications and variations of this disclosure provided they come within the scope of the appended claims and their equivalents.

What is claimed is:

1. A washing machine comprising:

a cabinet having an upper surface that comprises an upper cover that forms a rear part of the upper surface and a dispenser cover that forms a front part of the upper surface, the dispenser cover comprising:

a hole located in a front part of the upper surface and configured to be extended from one corner of the upper surface to an other corner of the upper surface; and a dispenser door that forms the front part of the upper surface and is configured to open or close the hole;

a tub provided in the cabinet;

a first detergent dispenser provided in the cabinet and having a first introduction hole through which detergent is introduced into the first detergent dispenser;

a second detergent dispenser provided in the cabinet and having a second introduction hole through which detergent is introduced into the second detergent dispenser;

an air supply unit including an introduction portion, which is at a circumferential surface of a rear part of the tub, a discharge portion, which is at a front part of the tub, and a duct, which is connected to both the discharge portion and the introduction portion; and a lock unit for maintaining an open or closed state of the dispenser door while the dispenser door is open or closed, wherein the first introduction hole and the second introduction hole are exposed to the outside of the cabinet when the dispenser door opens the hole, wherein the first introduction hole is configured to be located in one of two corners of the hole, and the second introduction hole is configured to be located in the other one of the two corners of the hole, and wherein the first introduction hole is located on one side of the duct and the second introduction hole is located on an other side of the duct.

2. The washing machine according to claim 1, wherein the dispenser cover further comprises a door bracket that is located over the first and the second detergent dispenser, and wherein the hole is provided in the door bracket, and the dispenser door is a sliding door, which is slidably coupled to the door bracket and which slides so as to open and close the hole.

3. The washing machine according to claim 2, wherein the door bracket comprises:

a body part having the hole; and a plurality of guide parts, which are on both lateral sides of the body part and are in inner facing surfaces of the lateral sides with first and second guide slits for guiding the sliding door, wherein the sliding door includes first and second slide protrusions formed on both lateral sides thereof, which are inserted in the first and the second guide slits, respectively.

4. The washing machine according to claim 3, wherein the first and the second guide slits are inclined downward in a direction in which the sliding door opens.

5. The washing machine according to claim 3, wherein the second guide slits have a greater angle of inclination than the first guide slits.

6. The washing machine according to claim 2, wherein the upper cover has a recessed surface, and the sliding door has a recessed surface, which is flush with the recessed surface of the upper cover.

7. The washing machine according to claim 6, wherein a front edge of the sliding door is a front edge of the cabinet, and wherein a connecting surface is between an upper surface of the sliding door and a front cover of the cabinet to connect the upper surface of the sliding door to the front cover of the cabinet.

8. The washing machine according to claim 7, wherein the connecting surface includes a flat or a curved surface.

9. The washing machine according to claim 2, wherein the lock unit is at the sliding door to restrict movement of the sliding door when the sliding door is opened and closed.

10. The washing machine according to claim 9, wherein the lock unit is inside a handle on the sliding door.

11. The washing machine according to claim 9, wherein the lock unit includes a push lever, which is inside a handle provided on the sliding door, a locking protrusion, and a return spring for maintaining a normal position of the push lever, and whereby, when the push lever is pushed, a locked state of the locking protrusion is released, and the sliding door becomes movable.

12. The washing machine according to claim 1, wherein the dispenser door forms a front edge of the upper surface of the cabinet.

13. The washing machine according to claim 1, wherein the dispenser door slides under the upper cover when the hole is open.

14. The washing machine according to claim 1, wherein the discharge portion is at a center of a front part of the tub, and the duct extends to the center of the front part of the tub from a rear part of the tub.

* * * * *